US010224019B2

(12) United States Patent
Mitchell et al.

(10) Patent No.: US 10,224,019 B2
(45) Date of Patent: Mar. 5, 2019

(54) WEARABLE AUDIO DEVICE

(71) Applicant: Audio Analytic Ltd., Cambridge (GB)

(72) Inventors: Chris James Mitchell, Cambridge (GB); Joe Patrick Lynas, Cambridge (GB); Julian Harris, Cambridge (GB); Arnoldas Jasonas, Cambridge (GB); Sacha Krstulovic, Cambridge (GB)

(73) Assignee: AUDIO ANALYTIC LTD. (GB)

( * ) Notice: Subject to any disclaimer, the term of this patent is extended or adjusted under 35 U.S.C. 154(b) by 0 days.

(21) Appl. No.: 15/893,015

(22) Filed: Feb. 9, 2018

(65) Prior Publication Data

US 2018/0233125 A1 Aug. 16, 2018

Related U.S. Application Data

(60) Provisional application No. 62/457,535, filed on Feb. 10, 2017.

(51) Int. Cl.

| | |
|---|---|
| ***H04R 5/02*** | (2006.01) |
| ***G10K 11/178*** | (2006.01) |
| ***G10L 25/51*** | (2013.01) |
| ***G10L 25/21*** | (2013.01) |
| ***G10L 25/78*** | (2013.01) |
| ***H04R 3/00*** | (2006.01) |
| ***H04S 7/00*** | (2006.01) |
| ***H04R 1/40*** | (2006.01) |

(52) U.S. Cl.

CPC ..... *G10K 11/17827* (2018.01); *G10L 25/21* (2013.01); *G10L 25/51* (2013.01); *G10L 25/78* (2013.01); *H04R 1/406* (2013.01); *H04R 3/005* (2013.01); *H04S 7/304* (2013.01); *G10K 2210/1081* (2013.01); *H04S 2400/11* (2013.01); *H04S 2420/01* (2013.01)

(58) Field of Classification Search

CPC ..... H04R 5/02

See application file for complete search history.

(56) References Cited

U.S. PATENT DOCUMENTS

| | | | | |
|---|---|---|---|---|
| 2008/0240458 | A1 | 10/2008 | Goldstein et al. | |
| 2014/0044269 | A1* | 2/2014 | Anderson | H04R 5/04 381/57 |
| 2014/0126734 | A1* | 5/2014 | Gauger, Jr. | H04R 3/002 381/71.6 |
| 2014/0270260 | A1* | 9/2014 | Goertz | G10L 25/84 381/110 |
| 2015/0112671 | A1* | 4/2015 | Johnston | H04R 3/005 704/233 |
| 2015/0294662 | A1* | 10/2015 | Ibrahim | G10K 11/17885 381/71.6 |
| 2016/0125869 | A1* | 5/2016 | Kulavik | G10K 11/178 381/71.6 |
| 2016/0192073 | A1* | 6/2016 | Poornachandran | G10L 25/51 381/26 |
| 2017/0142511 | A1* | 5/2017 | Dennis | H04R 1/1083 |

(Continued)

*Primary Examiner* — Olisa Anwah

(74) *Attorney, Agent, or Firm* — Tarolli, Sundheim, Covell & Tummino LLP

(57) ABSTRACT

Broadly speaking, embodiments of the present invention provide a wearable audio device including one or a plurality of microphones, a sound recognition systems and a controller to control the device based on one or more recognized sounds or classes of sound. Embodiments use stored sound models.

15 Claims, 13 Drawing Sheets

(56) References Cited

U.S. PATENT DOCUMENTS

| | | | | |
|---|---|---|---|---|
| 2017/0148428 | A1* | 5/2017 | Thuy | G10K 11/1788 |
| 2017/0193978 | A1* | 7/2017 | Goldman | G10K 11/1784 |
| 2017/0257072 | A1* | 9/2017 | Mehta | H03G 3/32 |
| 2018/0077483 | A1* | 3/2018 | Sahay | H04R 1/1091 |
| 2018/0137851 | A1* | 5/2018 | Kumar | G10K 11/178 |

* cited by examiner

710

WEARABLE AUDIO DEVICE

RELATED APPLICATIONS

The present invention is a U.S. Non-provisional application claiming priority to Ser. No. 62/457,535, filed on 10 Feb. 2017, which is incorporated herein by reference.

FIELD OF THE INVENTION

The invention generally relates to portable, for example wearable audio devices, and to related systems, methods and computer program code.

BACKGROUND TO THE INVENTION

Background information on sound identification systems and methods can be found in the applicant's PCT application WO2010/070314, which is hereby incorporated by reference in its entirety.

The present applicant has recognised the potential for new applications of this technology.

SUMMARY OF THE INVENTION

In broad terms a wearable audio device such as a set of headphones or earbuds includes at least one microphone, typically part of the wearable device but optionally incorporated into a remote device such as a mobile device or phone with a wired or wireless coupling to the wearable device. The wearable device is typically configured to be worn on a user's head and includes one or more speakers or similar audio transducers to convert an electrical signal into sound. The system also includes a sound identification module which may be incorporated in the wearable device or which may be located in the remote device or which may have functionality distributed between these two devices. Or potentially located elsewhere, for example, in the cloud. Broadly speaking in embodiments the sound identification module is configured to identify one or more target sounds and to adjust one or more settings or parameters of the wearable device and/or of the audio signal provided to the wearable device, in response.

In one aspect the wearable device may comprise noise cancelling headphones, a noise cancelling headset or the like, preferably with at least one accompanying microphone. In this case the system may be configured to identify speech and, in particular, to differentiate between speech produced by the wearer of the device and speech produced by a third party, for example an interlocutor. In response to detecting third party speech, the system may be configured to adjust the (active) noise cancellation system, and/or other features or functions of the wearable and/or a companion device, for example to reduce or switch off this system, more generally to control the "transparency" of the system to external noise. In this way such a system may facilitate a conversation with the wearer of a pair of active noise cancellation headphones.

Other features or functions of the wearable and/or a companion device may include, for example, music or other entertainment control such as pause/playback control; and/or communications control; and/or personal assistance communication/control. Further functions include a music recommendation function, an advertising function, and other service functions.

For example in a case where there is only one microphone, the system may have a classifier with a speech model which provides a time series of classification data. The classification data may include an envelope or measure of amplitude or energy of a detected speech signal. Where there are two speech signals present, one from the wearer and one from an interlocutor, the signals from the output of the classifier may be determined to have different energies. This can then be used to distinguish the signals, and hence distinguish when two or more different speakers are speaking.

Additionally or alternatively two (or more) classifiers may be employed to model the speech of each of two or more speakers, and hence distinguish when each is speaking. In this case a first of the models may be conditioned on a second model, so that the first model is able to discount when the first model identifies speech from a first speaker, to enable the second model to more accurately identify a second speaker. For example, a speech model, such as a neural network or hidden Markov model (HMM), may include a model component to represent a conversation in which speech from a first speaker is generally followed by speech from second, different speaker, and vice-versa.

In general, a speech model as described above is configured to detect the presence of speech, and/or distinguish between speakers. However it is not necessary to identify the semantic content of the speech. A speech model for the techniques described herein may comprise one or more of: a HMM, a neural network, a GMM (Gaussian mixture model), a support vector machine, or any other suitable type of acoustic sound classification system. Additionally or alternatively, a speech model as described above may be configured to detect a property or tone of speech, such as urgency, excitedness, volume and the like of the speech. The speech model may include, or be replaced by, other sound models. The system may be configured to perform different actions/functions depending upon the sound or sound type detected by the speech or other model.

The system may include a personal assistant or other system which synthesises speech. This may be employed to communicate a message to the user in response to a detected sound, for example a warning if an emergency vehicle is detected. The message may include a description of a location of the sound or may be presented to the ears of the user so as to give the impression of coming from the direction of the detected sound. Optionally a detected sound or sound environment may be used to control the semantic content and/or a tone or other property of the synthesised speech.

In some embodiments of the above described system there may be two microphones, one to pick up speech produced by the wearer, and one or more other microphones to detect third party speech. These microphones may be directed in different directions and may have a directional response to selectively respond to either sound from the wearer or external sound. In one embodiment a microphone to detect speech produced by the wearer may comprise a jawbone or other similar microphone, which reduces external interference. Additionally or alternatively, external speech may be detected by identifying when both the wearer/"internal" microphone and the exterior microphone both hear speech.

Additionally or alternatively signals from the two microphones may be employed jointly with one or more classifiers as described above to distinguish when different speakers are talking.

As previously described additionally or alternatively one or more of the microphones may be located in a companion device such as a mobile phone, smart glasses or other similar portable or worn device. Additionally or alternatively, in a system with earbuds one or more of the microphones may be incorporated into the earbud, for example on an outer part of the earbud and/or into a part of the earbud which resides in the ear canal when the bud is in use.

In addition to or instead of detecting speech the system may detect an external sound from the external environment, for example a sound indicating a hazard such as an emergency siren, horn or bell; a sound indicating an announcement.

The system may also characterise the external acoustic environment, using a classifier or similar to identify a physical environment, activity environment, or what may be termed an acoustic scene. A physical environment may be for example a street, home, room in a home; an activity environment may be for example traffic, cooking or the like; an acoustic scene may be for example time of day such as day/night or the general level or type of background noise, which impacts consumption of audio for example the intelligibility of speech or music listening.

More generally the system may be configured to learn new sounds, in order to respond to such new sounds. This may be implemented by capturing a sound, sending it to a remote data processing facility to model or develop a classifier for the sound, and then receive back parameters of the model, or for updating the model to detect the new sound. This may be under user control; the user may label the new sound for modelling.

In embodiments of this and other aspects of the systems, we describe an algorithm for detecting a particular target sound that may comprise two parts, in a first part, which may be implemented in hardware and/or software and/or both, sound (optionally of a generic type) is identified as being present and then this is used to invoke a more specific sound recognition system/module to distinguish the target sound. In this way a relatively lower power system can be used to identify the presence of a sound or of a sound having some similarity to the target sound, and then this may be used, for example, to control the power supply or operation of a hardware subsystem, for example booting up, or starting from sleep, a more specific sound identification module. In response to a detecting a specific target sound, such as a wake sound, the system may boot up from a sleep mode into a higher powered state. However even without any hardware control, breaking down the detection procedure into two stages means that the second, more computationally expensive (and hence power hungry) stage need only be invoked selectively.

In another aspect, which may operate additionally or alternatively to the first aspect, the target sound may comprise a sound characteristic of a particular environment, for example a coffee shop, train or the like. In this case settings of the wearable device may be controlled responsive to detection of a particular environment in which the user is located. Thus the settings controlled may comprise settings relating to volume, equalisation, tone or debility (algorithms are available to adjust the audibility of a sound/speech), or the like. Additionally or alternatively the wearable and/or remote device may be provided with multiple microphones and the signals captured from these microphones processed to selectively direct attention of the wearable device towards a target, for example another speaker. This may be achieved, for example, by having a plurality of directional microphones pointing in different directions and selecting one or more of these and/or by beam forming using an array of microphones, or in other ways.

For example, such techniques may be employed to selectively listen in a direction, for example of a speaker. Additionally or alternatively if the direction of a speaker or other sound source has been identified, for example as described above, reproduction of sound to the wearer of the device (headphones, earbuds and the like) may be controlled to give the impression to the wearer that the sound is originating from the identified direction. This may be implemented, for example, by adjusting the filtering and/or timing of signals delivered to the two ears of a listener. For example in one implementation one or more head-related transfer functions may be adjusted. Thus audio reproduction circuitry/software in the device may include a head-related transfer function, which may be audio modification function which mimics the perception of a physical sound by a person, taking into account propagation of the sound through and around the head of the person. Such a transfer function may be modified to give an impression of the sound originating from a particular direction.

The skilled person will appreciate that these techniques may be combined with or used separately from the previously described techniques.

In another example application a wearable exercise monitoring device such as a fitness tracker or the like may be controlled or provided with data in response to the detected environment, based upon the identified sound. For example on a train journey such a device may be confused as to whether the user is taking exercise and thus if the device knows that the location is a train internal parameters can be adjusted accordingly, for example to reduce the sensitive of the device or simply to, for example, stop counting steps during that period.

The skilled person will recognise that these techniques may be employed in a variety of different environments, for example street environments, vehicle environments (car, train, plane, bus, ship and so forth) and the like.

Some preferred embodiments of these techniques employ the sound recognition techniques that we have previously described or other sound recognition techniques which employ training on (labelled) examples of sounds. Thus a further aspect of the invention contemplates capturing suitable sound examples when additional data is available which defines the user environment. For example a coffee shop may be identified as a coffee shop by the name of its Wi-Fi signal and this may then be used to "crowdsource" data for training sound model of a coffee shop. The skilled person will appreciate that this may readily be generalised to other environments/locations based upon any type of data which identifies a particular environment/location including, but not limited to, RF environment data, location data (for example from a GPS say on a phone) and so forth.

In another aspect, which may operate additionally or alternatively to the previous aspects, the target sound may comprise a sound characteristic of a particular sound, typically associated with a warning, a hazard or imminent danger, for example a car horn, a fire alarm, a raised voice/shouting or the like. In response to identifying a received sound the system performs a predetermined operation associated with the identified sound. For example, the settings of the wearable device may be controlled responsive to detection of a particular sound. The controllable settings may comprise settings relating to volume, equalisation, tone or debility (algorithms are available to adjust the audibility of a sound/speech), turn active noise cancellation off, transmit outside noise to a speaker, give an alert either audible or a vibration, or the like. The skilled person will appreciate that these techniques may be combined with or used separately from the previously described techniques.

The skilled person will recognise that these techniques may be employed to a variety of different sounds, for example bicycle bells, people shouting, emergency vehicle sirens and the like.

In a related aspect of the invention there is provided a non-transitory data carrier carrying processor control code which when running on a device causes the device to operate as described.

It will be appreciated that the functionality of the devices we describe may be divided across several modules. Alternatively, the functionality may be provided in a single module or a processor. The or each processor may be implemented in any known suitable hardware such as a microprocessor, a Digital Signal Processing (DSP) chip, an Application Specific Integrated Circuit (ASIC), Field Programmable Gate Arrays (FPGAs), etc. The or each processor may include one or more processing cores with each core configured to perform independently. The or each processor may have connectivity to a bus to execute instructions and process information stored in, for example, a memory.

The invention further provides processor control code to implement the above-described systems and methods, for example on a general purpose computer system or on a digital signal processor (DSP). The invention also provides a carrier carrying processor control code to, when running, implement any of the above methods, in particular on a non-transitory data carrier—such as a disk, microprocessor, CD- or DVD-ROM, programmed memory such as read-only memory (Firmware), or on a data carrier such as an optical or electrical signal carrier. The code may be provided on a carrier such as a disk, a microprocessor, CD- or DVD-ROM, programmed memory such as non-volatile memory (e.g. Flash) or read-only memory (Firmware). Code (and/or data) to implement embodiments of the invention may comprise source, object or executable code in a conventional programming language (interpreted or compiled) such as C, or assembly code, code for setting up or controlling an ASIC (Application Specific Integrated Circuit) or FPGA (Field Programmable Gate Array), or code for a hardware description language such as Verilog™ or VHDL (Very high speed integrated circuit Hardware Description Language). As the skilled person will appreciate such code and/or data may be distributed between a plurality of coupled components in communication with one another. The invention may comprise a controller which includes a microprocessor, working memory and program memory coupled to one or more of the components of the system.

BRIEF DESCRIPTION OF THE DRAWINGS

Embodiments of the invention will be described, by way of example, with reference to the accompanying drawings, in which.

DETAILED DESCRIPTION OF THE DRAWINGS

By way of background we first describe examples of a device, systems and methods for capturing sounds, generating a sound model (or "sound pack") for each captured sound, and identifying a detected sound using the sound model(s). Preferably, a single device is used to capture a sound, store sound models, and to identify a detected sound using the stored sound models.

In example implementations, the sound model for each captured sound is generated in a remote sound analytics system, such that a captured sound is sent to the remote analytics system for processing, and the remote analytics system returns a sound model to the device. Additionally or alternatively, the sound analytics function is provided on the device which captures sound, via an analytics module located within the device itself.

An advantage is that a user of the device may use the device to capture sounds specific to their environment (e.g. the sound of their doorbell, the sound of their smoke detector, or the sound of their baby crying etc.) so that the sounds in their specific environment can be identified. Thus, a user can use the device to capture the sound of their smoke detector, obtain a sound model for this sound (which is stored on the device) and to define an action to be taken in response to the sound being identified, such as "send an SMS message to my phone". In this example, a user who is away from their home can be alerted to his smoke alarm ringing in his home. This and other examples are described in more detail below.

Preferably the sounds captured and identified by a device include environmental sounds (e.g. a baby crying, broken glass, car alarms, smoke alarms, doorbells, etc.), and may include individual word recognition (e.g. "help", "fire" etc.) but exclude identifying speech (i.e. speech recognition).

1. Sound Capture and Identification

Figure 1A:
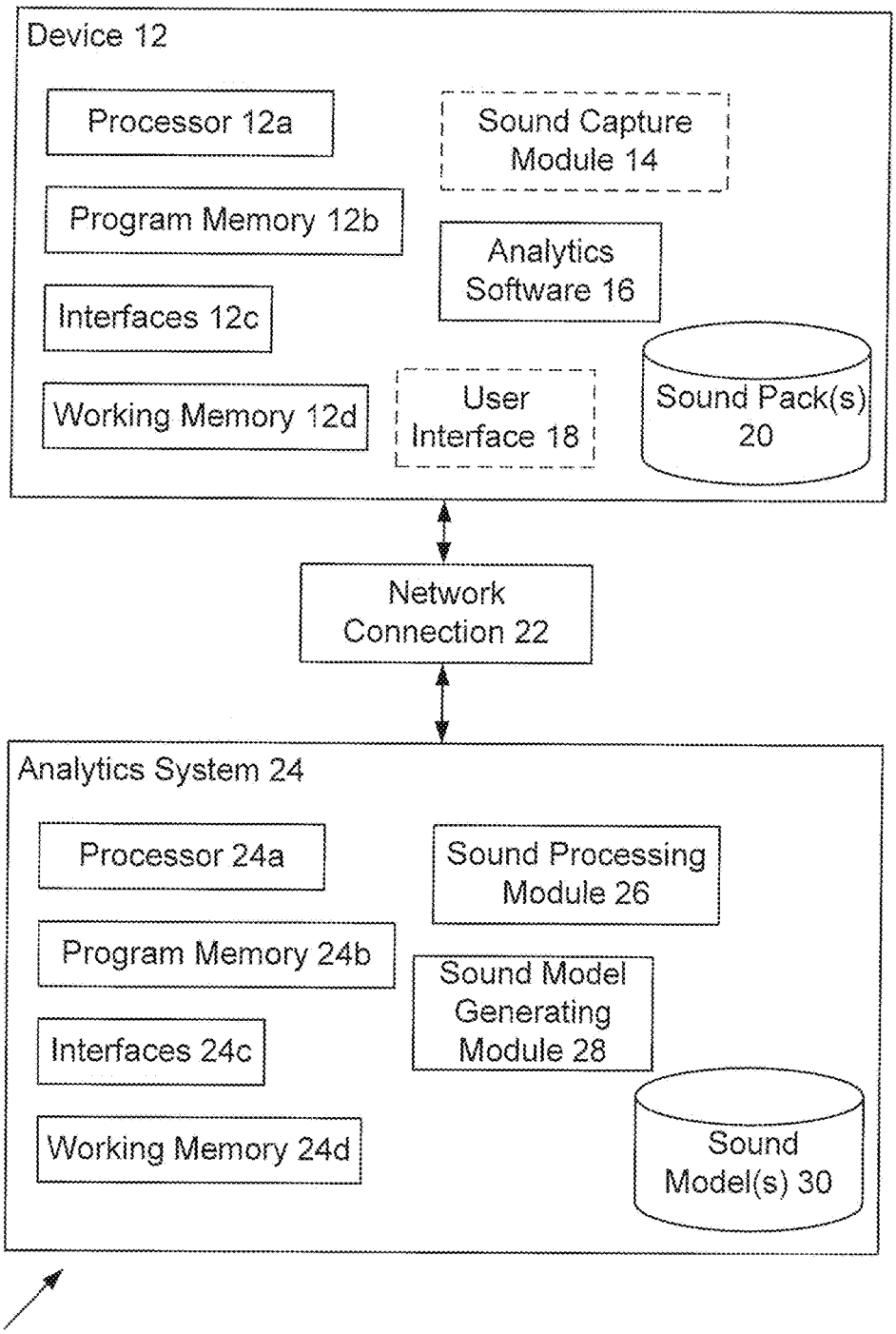
FIG. 1*a* shows a block diagram of a general system to generate sound models and identify detected sounds.

FIG. 1*a* shows a block diagram of a general system 10 to generate sound models and identify detected sounds. A device 12 is used to capture a sound, store a sound model associated with the captured sound, and use the stored sound model to identify detected sounds. The device 12 can be used to capture more than one sound and to store the sound models associated with each captured sound. The device 12 may be a PC, a mobile computing device such as a laptop, smartphone, tablet-PC, a consumer electronics device (e.g. a webcam, a smart microphone, etc.) or other electronics device (e.g. a security camera). The device comprises a processor 12*a* coupled to program memory 12*b* storing computer program code to implement the sound capture and sound identification, to working memory 12*d* and to interfaces 12*c* such as a screen, one or more buttons, keyboard, mouse, touchscreen, and network interface.

The processor 12*a* may be an ARM® device. The program memory 12*b* stores processor control code to implement functions, including an operating system, various types of wireless and wired interface, storage and import and export from the device.

In particular the device 12 comprises a user interface 18 to enable the user to, for example, associate an action with a particular sound. The user interface 18 may, alternatively, be provided via a second device (not shown), as explained in more detail with respect to FIG. 5 below. A wireless interface, for example a Bluetooth®, Wi-Fi or near field communication (NFC) interface is provided for interfacing with other devices and the analytics system 24.

The device 12 may comprise a sound capture module 14, such as a microphone and associated software. In other arrangements, the sound capture module 14 may be provided via a separate device (not shown), such that the function of capturing sounds is performed by a separate device. This is described in more detail with reference to FIG. 4*a* below.

The device 12 comprises a data store 20 storing one or more sound models (or "sound packs"). In example implementations, the sound model for each captured sound is generated in a remote sound analytics system 24, such that a captured sound is sent to the remote analytics system for processing, and the remote analytics system returns a sound model to the device. The device 12 may be configured to store user-defined or user-selected actions which are to be taken in response to the identification of a particular sound. This has an advantage that the device 12 which captures and identifies sounds does not require the processing power or any specific software to analyse sounds and generate sound models.

Another advantage is that the device 12 stores the sound models locally (in data store 20) and so does not need to be in constant communication with the remote system 24 in order to identify a captured sound.

Thus, the sound models are obtained from the analytics system 24 and stored within the device 12 (specifically within data store 20) to enable sounds to be identified using the device, without requiring the device to be connected to the analytics system. The device 12 also comprises analytics software 16 which is used to identify a detected sound, by comparing the detected sound to the sound models (or "sound packs") stored in the data store 20. In the example implementation of FIG. 1*a*, the analytics software is not configured to generate sound models for captured sounds, but merely to identify sounds using the stored sound models. The device 12 comprises a networking interface to enable communication with the analytics system 24 via the appropriate network connection 22 (e.g. the Internet). Captured sounds, for which sound models are to be generated, are sent to the analytics system 24 via the network connection 22.

In FIG. 1*a*, the analytics system 24 is located remote to the device 12. The analytics system 24 may be provided in a remote server, or a network of remote servers hosted on the Internet (e.g. in the Internet cloud), or in a device/system provided remote to device 12. For example, device 12 may be a computing device in a home or office environment, and the analytics system 24 may be provided within a separate device within the same environment. The analytics system 24 comprises at least one processor 24*a* coupled to program memory 24*b* storing computer program code to implement the sound model generation method, to working memory 24*d* and to interfaces 24*c* such as a network interface. The analytics system 24 comprises a sound processing module 26 configured to analyse and process captured sounds received from the device 12, and a sound model generating module 28 configured to create a sound model (or "sound pack") for a sound analysed by the sound processing module 26. In example implementations, the sound processing module 26 and sound model generating module 28 are provided as a single module.

The analytics system 24 further comprises a data store 30 containing sound models generated for sounds received from one or more devices 12 coupled to the analytics system 24. The stored sound models may be used by the analytics system 24 (i.e. the sound processing module 26) as training for other sound models, to perform quality control of the process to provide sound models, etc.

Figure 1B:
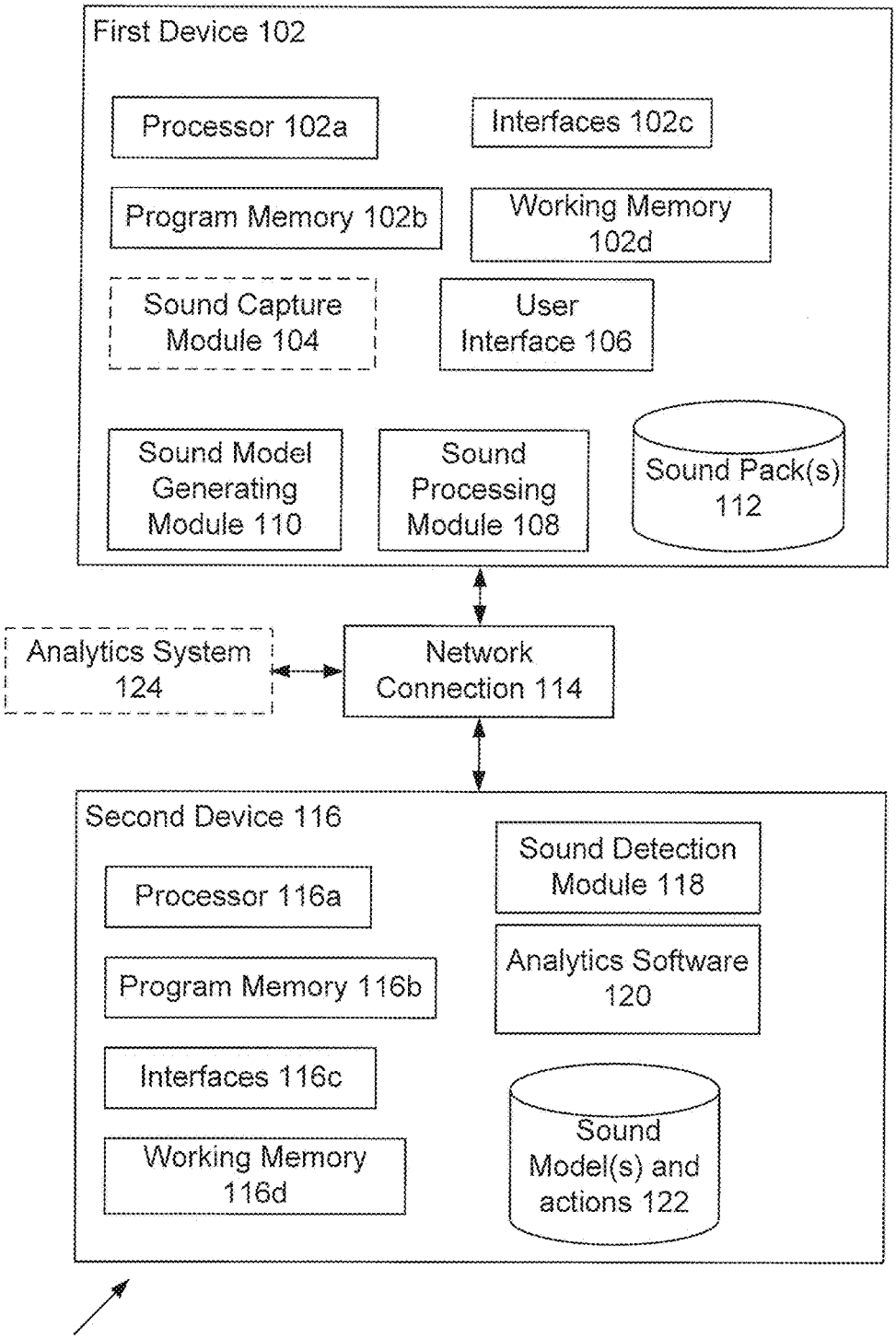
FIG. 1*b* shows a block diagram of a general system to generate sound models and identify detected sounds.

FIG. 1*b* shows a block diagram of a general system 100 to generate sound models and identify detected sounds in a further example implementation. In this example implementation, a first device 102 is used to capture a sound, generate a sound model for the captured sound, and store the sound model associated with the captured sound. The sound models generated locally by the first device 102 are provided to a second device 116, which is used to identify detected sounds. The first device 102 of FIG. 1*b* therefore has the processing power required to perform the sound analysis and sound model generation itself, in contrast with the device of FIG. 1*a*, and thus a remote analytics system is not required to perform sound model generation.

The first device 102 can be used to capture more than one sound and to store the sound models associated with each captured sound. The first device 102 may be a PC, a mobile computing device such as a laptop, smartphone, tablet-PC, a consumer electronics device (e.g. a webcam, a smart microphone, a smart home automation panel etc.) or other electronics device. The first device comprises a processor 102*a* coupled to program memory 102*b* storing computer program code to implement the sound capture and sound model generation, to working memory 102*d* and to interfaces 102*c* such as a screen, one or more buttons, keyboard, mouse, touchscreen, and network interface.

The processor 102*a* may be an ARM® device. The program memory 102*b* stores processor control code to implement functions, including an operating system, various types of wireless and wired interface, storage and import and export from the device.

The first device 102 comprises a user interface 106 to enable the user to, for example, associate an action with a particular sound. The user interface may be display screen, which requires a user to interact with it via an intermediate device such as a mouse or touchpad, or may be a touchscreen. A wireless interface, for example a Bluetooth®, Wi-Fi or near field communication (NFC) interface is provided for interfacing with the second device 116 and optionally, with a remote analytics system 124. In example implementations, although the first device 102 has the capability to analyse sounds and generate sound models itself, the first device 102 may still communicate with a remote analytics system 124. For example, the first device 102 may provide the captured sounds and/or the locally-generated sound models to the remote analytics system 124 for quality control purposes or to perform further analysis on the captured sounds. Advantageously, the analysis performed by the remote system 124, based on the captured sounds and/or sound models generated by each device coupled to the remote system 124, may be used to update the software and analytics used by the first device 102 to generate sound models. The analytics system 124 may therefore comprise at least one processor, program memory storing computer program code to analyse captured sounds, working memory, interfaces such as a network interface, and a data store containing sound models received from one or more devices coupled to the analytics system 124.

The first device 102 may, example implementations, comprise a sound capture module 104, such as a microphone and associated software. In other example implementations the sound capture module 104 may be provided via a separate device (not shown), such that the function of capturing sounds is performed by a separate device. In either case, the first device 102 receives a sound for analysis.

The first device 102 comprises a sound processing module 108 configured to analyse and process captured sounds, and a sound model generating module 110 configured to create a sound model (or "sound pack") for a sound analysed by the sound processing module 108. In example implementations, the sound processing module 108 and sound model generating module 110 are provided as a single module. The first device 102 further comprises a data store 112 storing one or more sound models (or "sound packs"). The first device 102 may be configured to store user-defined or user-selected actions which are to be taken in response to the identification of a particular sound. The user interface 106 is used to input user-selected actions into the first device 102.

The sound models generated by the sound model generating module 110 of device 102 are provided to the second device 116 to enable the second device to identify detected sounds. The second device 116 may be a PC, a mobile computing device such as a laptop, smartphone, tablet-PC, a consumer electronics device or other electronics device. In a particular example implementations, the first device 102 may be a smart panel (e.g. a home automation system/device) or computing device located within a home or office, and the second device 116 may be an electronics device located elsewhere in the home or office. For example, the second device 116 may be a security system.

The second device 116 receives sound packs from the first device 102 and stores them locally within a data store 122. The second device comprises a processor 116*a* coupled to program memory 116*b* storing computer program code to implement the sound capture and sound identification, to working memory 116*d* and to interfaces 116*c* such as a screen, one or more buttons, keyboard, mouse, touchscreen, and network interface. The second device 116 comprises a sound detection module 118 which is used to detect sounds. Analytics software 120 stored on the second device 116 is configured to analyse the sounds detected by the detection module 118 by comparing the detected sounds to the stored sound model(s). The data store 122 may also comprise user-defined actions for each sound model. In the example implementation where the second device 116 is a security system (comprising at least a security camera), the second device 116 may detect a sound, identify it as the sound of breaking glass (by comparing the detected sound to a sound model of breaking glass) and in response, perform the user-defined action to swivel a security camera in the direction of the detected sound.

The processor 116*a* may be an ARM® device. The program memory 116*b*, in example implementations, stores processor control code to implement functions, including an operating system, various types of wireless and wired interface, storage and import and export from the device. The second device 116 comprises a wireless interface, for example a Bluetooth®, Wi-Fi or near field communication (NFC) interface, for interfacing with the first device 102 via network connection 114.

An advantage of the example implementation of FIG. 1*b* is that the second device 116 stores the sound models locally (in data store 122) and so does not need to be in constant communication with a remote system 124 or the first device 102 in order to identify a detected sound.

Figure 1C:
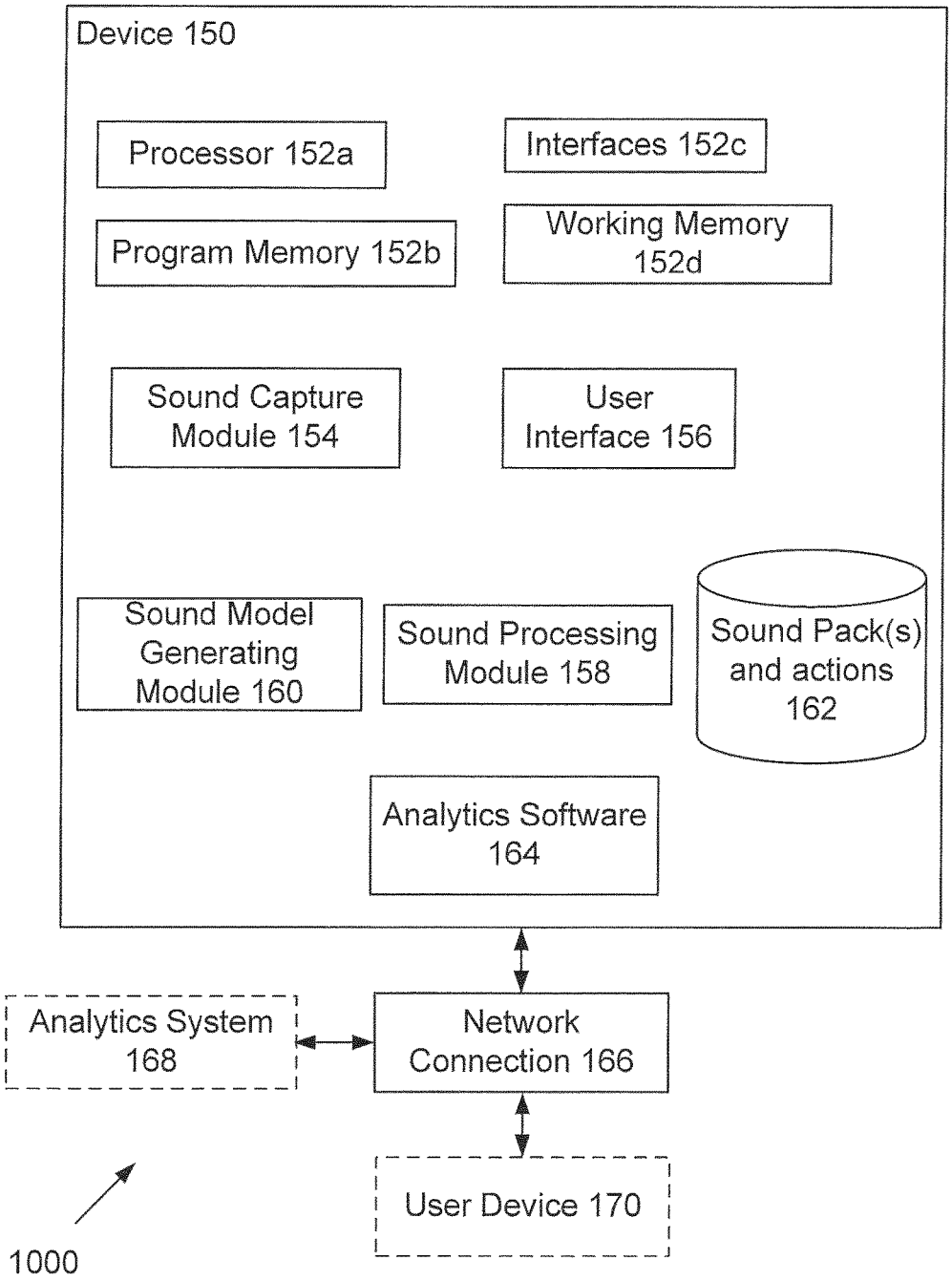
FIG. 1*c* shows a block diagram of a general system to generate sound models and identify detected sounds.

FIG. 1*c* shows a block diagram of a general system 1000 to generate sound models and identify detected sounds in a further example implementation. In this example implementation, a device 150 is used to capture a sound, generate a sound model for the captured sound, store the sound model associated with the captured sound, and identify detected sounds. The sound models generated locally by the device 150 are used by the same device to identify detected sounds. The device 150 of FIG. 1*c* therefore has the processing power required to perform the sound analysis and sound model generation itself, in contrast with the device of FIG. 1*a*, and thus a remote analytics system is not required to perform sound model generation. A specific example of this general system 1000 is described below in more detail with reference to FIG. 5.

In FIG. 1*c*, the device 150 can be used to capture more than one sound and to store the sound models associated with each captured sound. The device 150 may be a PC, a mobile computing device such as a laptop, smartphone, tablet-PC, a consumer electronics device (e.g. a webcam, a smart microphone, a smart home automation panel etc.) or other electronics device. The device comprises a processor 152*a* coupled to program memory 152*b* storing computer program code to implement the methods to capture sound, generate sound models and identify detected sounds, to working memory 152*d* and to interfaces 152*c* such as a screen, one or more buttons, keyboard, mouse, touchscreen, and network interface.

The processor 152*a* may be an ARM® device. The program memory 152*b* stores processor control code to implement functions, including an operating system, various types of wireless and wired interface, storage and import and export from the device.

The first device 150 comprises a user interface 156 to enable the user to, for example, associate an action with a particular sound. The user interface may be display screen, which requires a user to interact with it via an intermediate device such as a mouse or touchpad, or may be a touchscreen. A wireless interface, for example a Bluetooth®, Wi-Fi or near field communication (NFC) interface is provided for interfacing with a user device 170 and optionally, with a remote analytics system 168. In example implementations, although the device 150 has the capability to analyse sounds, generate sound models itself and identify detected sounds, the device 150 may also be coupled to a remote analytics system 168. For example, the device 150 may provide the captured sounds and/or the locally-generated sound models to the remote analytics system 168 for quality control purposes or to perform further analysis on the captured sounds. Advantageously, the analysis performed by the remote system 168, based on the captured sounds and/or sound models generated by each device coupled to the remote system 1268, may be used to update the software and analytics used by the device 150 to generate sound models. The device 150 may be able to communicate with a user device 170 to, for example, alert a user to a detected sound. A user of device 150 may specify, for example, that the action to be taken in response to a smoke alarm being detected by device 150 is to send a message to user device 170 (e.g. an SMS message or email). This is described in more detail with reference to FIG. 5 below.

The device 150 may, in example implementations, comprise a sound capture module 154, such as a microphone and associated software. In other example implementations, the sound capture module 154 may be provided via a separate device (not shown) coupled to the device 150, such that the function of capturing sounds is performed by a separate device. In either case, the device 150 receives a sound for analysis. The device 150 comprises a sound processing module 158 configured to analyse and process captured sounds, and a sound model generating module 160 configured to create a sound model (or "sound pack") for a sound analysed by the sound processing module 158. In example implementations, the sound processing module 158 and sound model generating module 160 are provided as a single module. The device 150 further comprises a data store 162 storing one or more sound models (or "sound packs"). The device 150 may be configured to store user-defined or user-selected actions which are to be taken in response to the identification of a particular sound in data store 162. The user interface 156 is used to input user-selected actions into the device 150.

The sound models generated by the sound model generating module 160 are used by device 150 to identify detected sounds. An advantage of the example implementation of FIG. 1*c* is that a single device 150 stores the sound models locally (in data store 162) and so does not need to be in constant communication with a remote system 168 in order to identify a detected sound.

2. Sound Model Generation

Figure 2A:
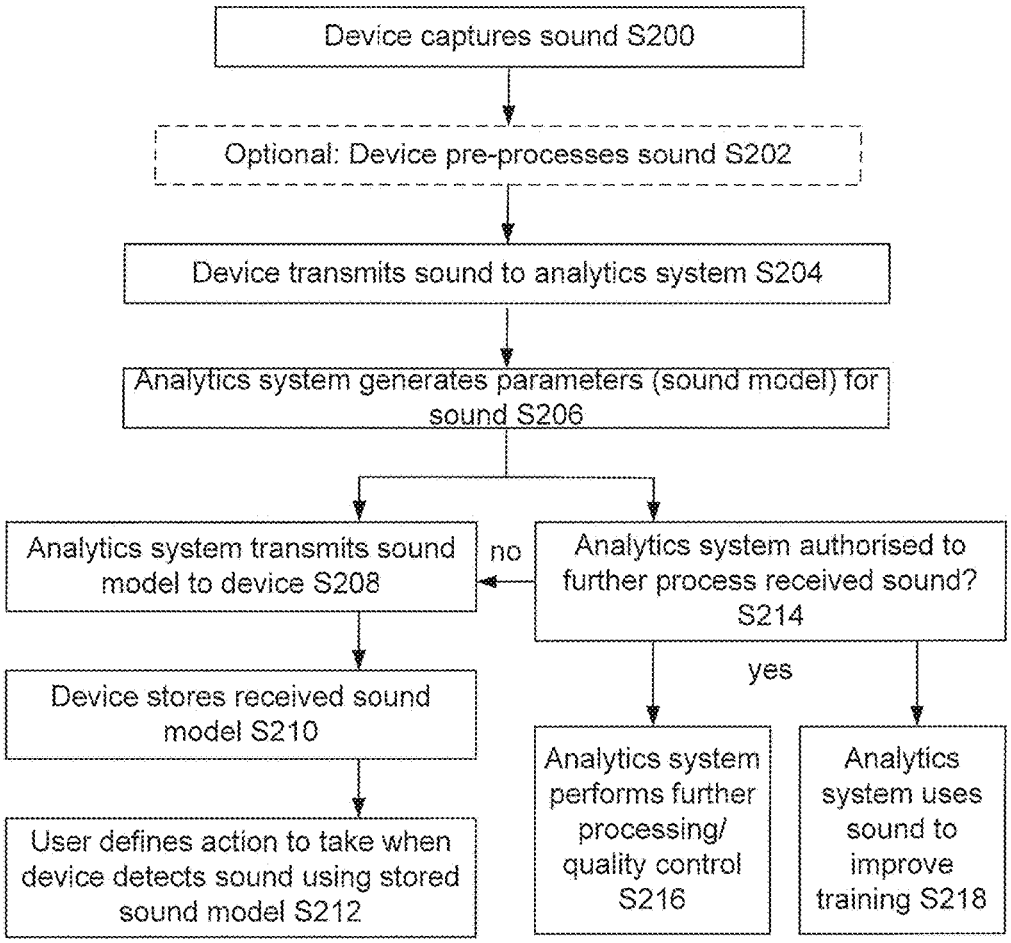
FIG. 2*a* is a flow chart showing example steps of a process to generate a sound model for a captured sound.

FIG. 2*a* is a flow chart showing example steps of a process to generate a sound model for a captured sound, where the sound analysis and sound model generation is performed in a system/device remote to the device which captures the sound. A device, such as device 12 in FIG. 1*a*, captures a sound (S200) and transmits the captured sound to a remote analytics system (S204). As mentioned earlier, the analytics system may be provided in a remote server, or a network of remote servers hosted on the Internet (e.g. in the Internet cloud), or in a device/system provided remote to the device which captures the sound. For example, the device may be a computing device in a home or office environment, and the analytics system may be provided within a separate device within the same environment, or may be located outside that environment and accessible via the Internet.

Preferably, the same sound is captured more than once by the device in order to improve the reliability of the sound model generated of the captured sound. The device may prompt the user to, for example, play a sound (e.g. ring a doorbell, test their smoke alarm, etc.) multiple times (e.g. three times), so that it can be captured multiple times. The device may perform some simple analysis of the captured sounds to check that the same sound has been captured, and if not, may prompt the user to play the sound again so it can be recaptured.

Optionally, the device may pre-process the captured sound (S202) before transmission to the analytics system. The pre-processing may be used to compress the sound, e.g. using a modified discrete cosine transform, to reduce the amount of data being sent to the analytics system.

The analytics system processes the captured sound(s) and generates parameters for the specific captured sound (S206). The sound model generated by the analytics system comprises these generated parameters and other data which can be used to characterise the captured sound. The sound model is supplied to the device (S208) and stored within the device (S210) so that it can be used to identify detected sounds. Preferably, a user defines an action to take when a particular sound is identified, such that the action is associated with a sound model (S212). For example, a user may specify that if a smoke alarm is detected, the device sends a message to a user's phone and/or to the emergency services. Another example of a user specified action is to send a message to or place a call to the user's phone in response to the detection of the user's doorbell. This may be useful if the user is in his garden or garage and out of earshot of his doorbell.

A user may be asked if the captured sound can be used by the analytics system to improve the models and analytics used to generate sound models. If the user has provided approval (e.g. on registering to use the analytics system), the analytics system performs further processing of the captured sounds and/or performs quality control (S216). The analytics system may also use the captured sounds received from each device coupled to the system to improve model generation, e.g. by using the database of sounds a training for other sound models (S218). The analytics system may itself generate sound packs, which can be downloaded/obtained by users of the system, based on popular captured sounds.

In the example implementations shown in FIGS. 1*b* and 1*c*, all of steps S200 to S212 are instead performed on the device which captures the sound. In these example implementations, the captured sounds and locally generated sound models may be sent to the analytics system for further analysis/quality control (S216) and/or to improve the software/analysis techniques used to generate sound models (S218). The improved software/analysis techniques are sent back to the device which generates sound models.

Preferably, the user defines an action for each captured sound for which a model is generated from a pre-defined list. The list may include options such as "send an SMS message", "send an email", "call a number", "contact the emergency services", "contact a security service", which may further require a user to specify a phone number or email address to which an alert is sent. Additionally or alternatively, the action may be to provide a visual indication on the device itself, e.g. by displaying a message on a screen on the device and/or turning on or flashing a light or other indicator on the device, and/or turning on an alarm on the device, etc.

There are a number of ways a sound model for a captured sound can be generated. The analytics system may use a statistical Markov model for example, where the parameters generated to characterise the captured sound are hidden Markov model (HMM) parameters. Additionally or alternatively, the sound model for a captured sound may be generated using machine learning techniques or predictive modelling techniques such as: neural networks, support vector machine (SVM), decision tree learning, etc.

The applicant's PCT application WO2010/070314, which is incorporated by reference in its entirety, describes in detail various methods to identify sounds. Broadly speaking an input sample sound is processed by decomposition into frequency bands, and optionally de-correlated, for example, using PCA/ICA, and then this data is compared to one or more Markov models to generate log likelihood ratio (LLR) data for the input sound to be identified. A (hard) confidence threshold may then be employed to determine whether or not a sound has been identified; if a "fit" is detected to two or more stored Markov models then preferably the system picks the most probable. A sound is "fitted" to a model by effectively comparing the sound to be identified with expected frequency domain data predicted by the Markov model. False positives are reduced by correcting/updating means and variances in the model based on interference (which includes background) noise.

Whilst embodiments described herein describe the identification of audio and the creation of sound models as detailed above, it will be appreciated that other methods of audio identification may be used. Furthermore, it will be appreciated that other techniques may be employed to create a sound model.

There are several practical considerations when trying to detect sounds from compressed audio formats in a robust and scalable manner Where the sound stream is uncompressed to PCM (pulse code modulated) format and then passed to a classification system, the first stage of an audio analysis system may be to perform a frequency analysis on the incoming uncompressed PCM audio data. However, the recently compressed form of the audio may contain a detailed frequency description of the audio, for example where the audio is stored as part of a lossy compression system. By directly utilising this frequency information in the compressed form, i.e., sub-band scanning in an example implementation of the above, a considerable computational saving may be achieved by not uncompressing and then frequency analysing the audio. This may mean a sound can be detected with a significantly lower computational requirement. Further advantageously, this may make the application of a sound detection system more scalable and enable it to operate on devices with limited computational power which other techniques could not operate on.

The digital sound identification system may comprise discrete cosine transform (DCT) or modified DCT coefficients. The compressed audio data stream may be an MPEG standard data stream, in particular an MPEG 4 standard data stream.

The sound identification system may work with compressed audio or uncompressed audio. For example, the time-frequency matrix for a 44.1 KHz signal might be a 1024 point FFT with a 512 overlap. This is approximately a 20 milliseconds window with 10 millisecond overlap. The resulting 512 frequency bins are then grouped into sub bands, or example quarter-octave ranging between 62.5 to 8000 Hz giving 30 sub-bands.

A lookup table is used to map from the compressed or uncompressed frequency bands to the new sub-band representation bands. For the sample rate and STFT size example given the array might comprise of a (Bin size÷2)×6 array for each sampling-rate/bin number pair supported. The rows correspond to the bin number (centre)—STFT size or number of frequency coefficients. The first two columns determine the lower and upper quarter octave bin index numbers. The following four columns determine the proportion of the bins magnitude that should be placed in the corresponding quarter octave bin starting from the lower quarter octave defined in the first column to the upper quarter octave bin defined in the second column. e.g. if the bin overlaps two quarter octave ranges the 3 and 4 columns will have proportional values that sum to 1 and the 5 and 6 columns will have zeros. If a bin overlaps more than one sub-band more columns will have proportional magnitude values. This example models the critical bands in the human auditory system. This reduced time/frequency representation is then processed by the normalisation method outlined. This process is repeated for all frames incrementally moving the frame position by a hop size of 10 ms. The overlapping window (hop size not equal to window size) improves the time-resolution of the system. This is taken as an adequate representation of the frequencies of the signal which can be used to summarise the perceptual characteristics of the sound. The normalisation stage then takes each frame in the sub-band decomposition and divides by the square root of the average power in each sub-band. The average is calculated as the total power in all frequency bands divided by the number of frequency bands. This normalised time frequency matrix is the passed to the next section of the system where its mean, variances and transitions can be generated to fully characterise the sound's frequency distribution and temporal trends. The next stage of the sound characterisation requires further definitions. A continuous hidden Markov model is used to obtain the mean, variance and transitions needed for the model. A Markov model can be completely characterised by $\lambda=(A, B, \Pi)$ where A is the state transition probability matrix, B is the observation probability matrix and $\Pi$ is the state initialisation probability matrix. In more formal terms:

$$A=\lfloor a_{ij}\rfloor \text{ where } a_{ij}\equiv P(q_{t+1}=S_j|q_t=S_i)$$

$$B=\lfloor b_j(m)\rfloor \text{ where } b_j(m)\equiv P(O_t=v_m|q_t=S_j)$$

$$\Pi=[\pi_i] \text{ where } \pi_i\equiv P(q_1=S_i)$$

where q is the state value, O is the observation value. A state in this model is actually the frequency distribution characterised by a set of mean and variance data. However, the formal definitions for this will be introduced later. Generating the model parameters is a matter of maximising the probability of an observation sequence. The Baum-Welch algorithm is an expectation maximisation procedure that has been used for doing just that. It is an iterative algorithm where each iteration is made up of two parts, the expectation $\varepsilon_t(i, j)$ and the maximisation $\gamma_t(i)$. In the expectation part, $\varepsilon_t(i, j)$ and $\gamma_t(i)$, are computed given $\lambda$, the current model values, and then in the maximisation $\lambda$ is step recalculated. These two steps alternate until convergence occurs. It has been shown that during this alternation process, $P(O|\lambda)$ never decreases. Assume indicator variables $z_i^t$ as Expectation $$\varepsilon_t(i, j) = \frac{\alpha_t(i)a_{ij}b_j(O_{t+1})\beta_{t+1}(j)}{\sum_k \sum_l \alpha(k)a_{kl}b_l(O_{t+1})\beta_{t+1}(l)}$$

$$\gamma_t(i) = \sum_{j=1}^{N} \varepsilon_t(i, j)$$

$$E[z_i^t] = \gamma_t(i) \text{ and } [z_{ij}^t] = \varepsilon_t(i, j)$$

$$z_i^t = \begin{cases} 1 \text{ if } q_t = S_i \\ 0 \text{ otherwise} \end{cases}$$

$$z_{ij}^t = \begin{cases} 1 \text{ if } q_t = S_i \text{ and } q_{t+1} = S_j \\ 0 \text{ otherwise} \end{cases}$$

Maximisation $$\hat{a}_{ij} = \frac{\sum_{k=1}^{K} \sum_{t=1}^{T_k-1} \varepsilon_t^k(i, j)}{\sum_{k=1}^{K} \sum_{t=1}^{T_k-1} \gamma_t^k(i)}$$

$$\hat{b}_j(m) = \frac{\sum_{k=1}^{K} \sum_{t=1}^{T_k-1} \gamma_t^k(j)1(O_t^k = v_m)}{\sum_{k=1}^{K} \sum_{t=1}^{T_k-1} \gamma_t^k(j)}$$

$$\hat{\pi} = \frac{\sum_{k=1}^{K} \gamma_1^k(i)}{K}$$

Gaussian mixture models can be used to represent the continuous frequency values, and expectation maximisation equations can then be derived for the component parameters (with suitable regularisation to keep the number of parameters in check) and the mixture proportions. Assume a scalar continuous frequency value, $O_t \in \Re$ with a normal distribution $$p(O_t|q_t=S_j,\lambda)\sim N(\mu_j,\sigma_j^2)$$

This implies that in state $S_j$, the frequency distribution is drawn from a normal distribution with mean $\mu_j$ and variance $\sigma_j^2$. The maximisation step equation is then $$\hat{\mu}_j = \frac{\sum_t \gamma_t(j) O_t}{\sum_t \gamma_t(j)}$$

$$\hat{\sigma}_j^2 = \frac{\sum_t \gamma_t(j)(O_{t-1} - \hat{\mu}_j)^2}{\sum_t \gamma_t(j)}$$

The use of Gaussians enables the characterisation of the time-frequency matrix's features. In the case of a single Gaussian per state, they become the states. The transition matrix of the hidden Markov model can be obtained using the Baum-Welch algorithm to characterise how the frequency distribution of the signal change over time.

The Gaussians can be initialised using K-Means with the starting points for the clusters being a random frequency distribution chosen from sample data.

To classify new sounds and adapt for changes in the acoustic conditions, a forward algorithm can be used to determine the most likely state path of an observation sequence and produce a probability in terms of a log likelihood that can be used to classify and incoming signal. The forward and backward procedures can be used to obtain this value from the previously calculated model parameters. In fact only the forward part is needed. The forward variable $\alpha_t(i)$ is defined as the probability of observing the partial sequence $\{O_1 \ldots O_t\}$ until time t and being in $S_i$ at time t, given the model $\lambda$.

$$\alpha_t(i) \equiv P(O_1 \ldots O_t, q_t=S_i|\lambda)$$

This can be calculated by accumulating results and has two steps, initialisation and recursion. $\alpha_t(i)$ explains the first t observations and ends in state $S_i$. This is multiplied by the probability $a_{ij}$ of moving to state $S_j$, and because there are N possible previous states, there is a need to sum over all such possible previous $S_i$. The term $b_j(O_{t+1})$ is then the probability of generating the next observation, frequency distribution, while in state $S_j$ at time t+1. With these variables it is then straightforward to calculate the probability of a frequency distribution sequence.

$$P(O \mid \lambda) = \sum_{i=1}^{N} \alpha_T(i)$$

Computing $\alpha_t(i)$ has order $O(N^2T)$ and avoids complexity issues of calculating the probability of the sequence. The models will operate in many different acoustic conditions and as it is practically restrictive to present examples that are representative of all the acoustic conditions the system will come in contact with, internal adjustment of the models will be performed to enable the system to operate in all these different acoustic conditions. Many different methods can be used for this update. For example, the method may comprise taking an average value for the sub-bands, e.g. the quarter octave frequency values for the last T number of seconds. These averages are added to the model values to update the internal model of the sound in that acoustic environment.

3. Identify Detected Sounds

Figure 2B:
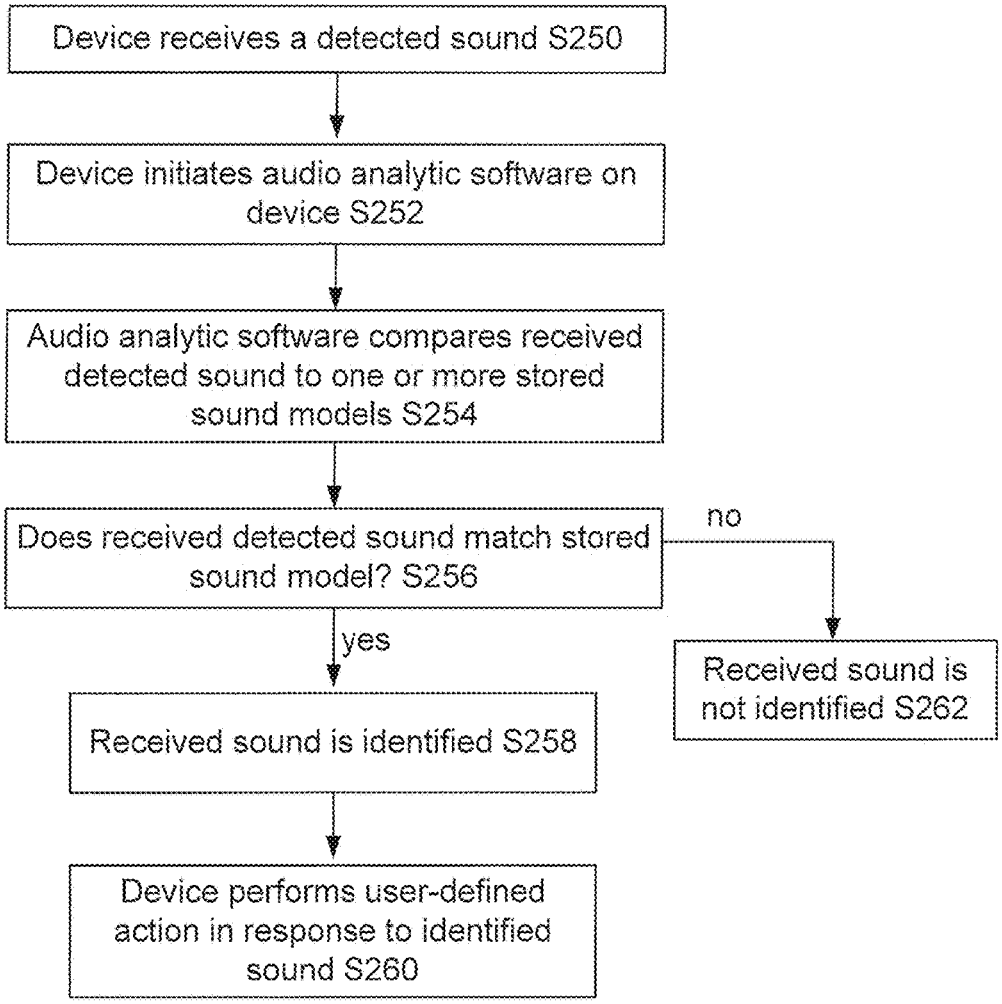
FIG. 2*b* is a flow chart showing example steps of a process to identify a detected sound using a sound model.

FIG. 2*b* is a flow chart showing example steps of a process to identify a detected sound using a sound model. A device receives a detected sound (S250), either via its own sound capture module (e.g. a microphone and associated software), or from a separate device. The device initiates audio analytics software stored on the device (S252) in order to analyse the detected sound. The audio analytics software identifies the detected sound by comparing it to one or more sound models stored within the device (S254). If the detected sound matches one of the stored sound models (S256), then the sound is identified (S258). If an action has been defined and associated with a particular sound/sound model, then the device is preferably configured to implement the action in response to the identification of the sound (S260). For example, the device may be configured to send a message or email to a second device, or to otherwise alert a user to the detection. If the detected sound does not match one of the stored sound models, then the detected sound is not identified (S262) and the process terminates. This means that in an environment such as a home, where many different sounds may be detected, only those sounds which the user has specifically captured (and for which sound models are generated) can be detected.

The device is preferably configured to detect more than one sound at a time. In this case, the device will run two analytics functions simultaneously. An indication of each sound detected and identified is provided to the user.

4. Example Systems to Capture and Identify Sounds

Figure 3:
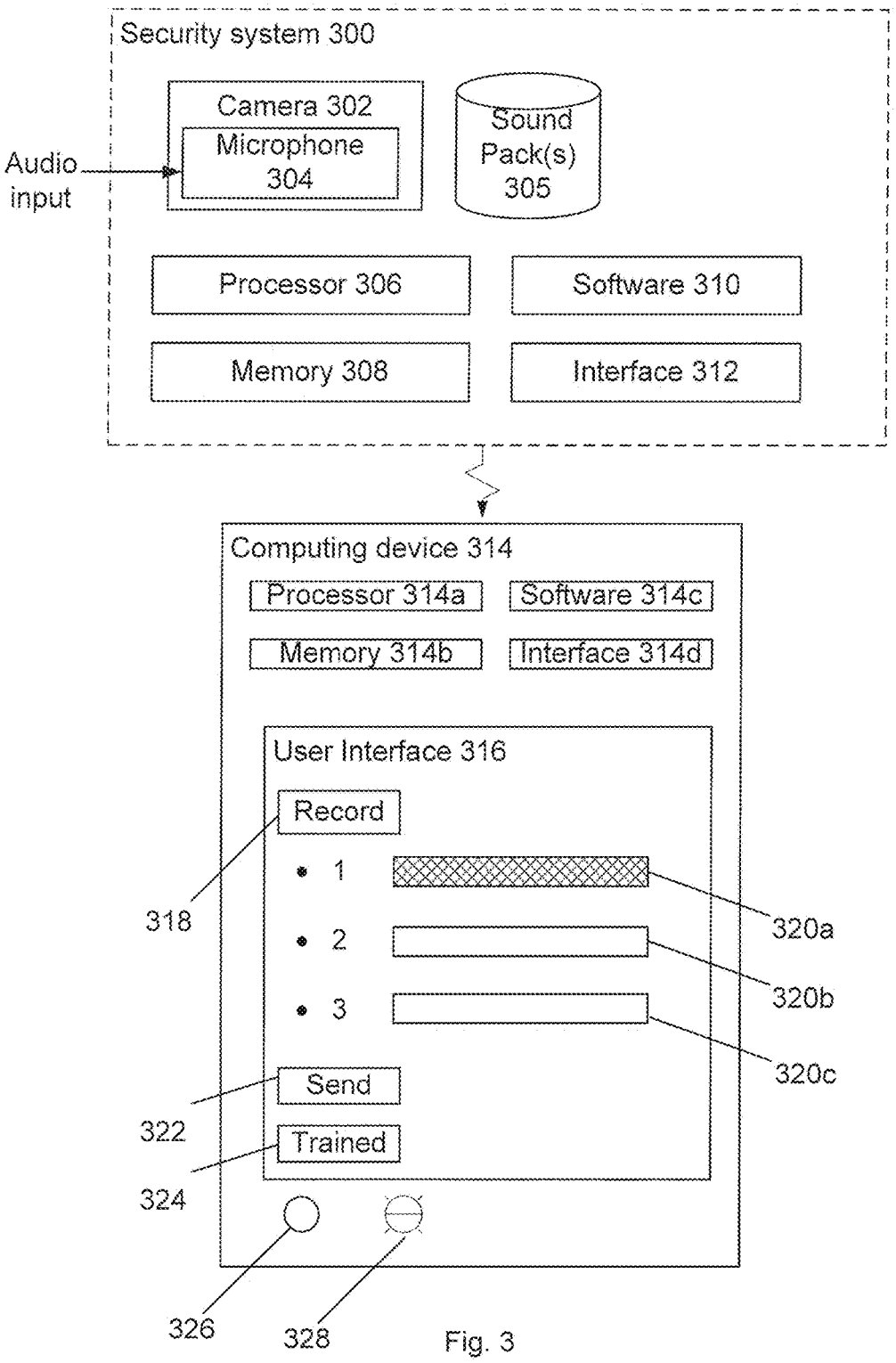
FIG. 3 is a block diagram showing a specific example of a system to capture and identify sounds.

FIG. 3 is a block diagram showing a specific example of a system to capture and identify sounds. The system comprises a security system 300 which is used to capture sounds and identify sounds. (It will be understood that the security system is just an example of a system which can be used to capture and identify sounds.) The security system 300 can be used to capture more than one sound and to store the sound models associated with each captured sound. The security system comprises a processor 306 coupled to memory 308 storing computer program code 310 to implement the sound capture and sound identification, and to interfaces 312 such as a network interface. A wireless interface, for example a Bluetooth®, Wi-Fi or near field communication (NFC) interface is provided for interfacing with a computing device 314.

The security system 300 comprises a security camera 302 and a sound capture module or microphone 304. The security system 300 comprises a data store 305 storing one or more sound models (or "sound packs"). In example implementations, the sound model for each captured sound is generated in a remote sound analytics system (not shown), such that a captured sound is sent to the remote analytics system for processing. In this illustrated example implementation, the security system 300 is configured to capture sounds in response to commands received from a computing device 314, which is coupled to the security system. The computing device 314 may be a user device such as a PC, mobile computing device, smartphone, laptop, tablet-PC, home automation panel, etc. Sounds captured by the microphone 304 are transmitted to the computing device 314, and the computing device 314 sends these to a remote analytics system for analysis. The remote analytics system returns a sound model for the captured sound to the device 314, and the device 314 provides this to the security system 300 for storage in the data store 305. This has an advantage that the security system which captures and identifies sounds, and the device 314 which is coupled to the analytics system, do not require the processing power or any specific software to analyse sounds and generate sound models. Another advantage is that the security system 300 stores the sound models locally (in data store 305) and so does not need to be in constant communication with the remote system or with the computing device 314 in order to identify a detected sound.

The computing device 314 may be a user device such as a PC, mobile computing device, smartphone, laptop, tablet-PC, home automation panel, etc., and comprises a processor 314*a*, a memory 314*b*, software to perform the sound capture 314*c* and one or more interfaces 314*d*. The computing device 314 may be configured to store user-defined or user-selected actions which are to be taken in response to the identification of a particular sound. A user interface 316 on the computing device 314 enables the user to perform the sound capture and to select actions to be taken in association with a particular sound. The user interface 316 shown here is a display screen (which may be a touchscreen) which, when the sound capture software is running on the device 314, displays a graphical user interface to lead the user through a sound capture process. For example, the user interface may display a "record" button 318 which the user presses when they are ready to capture a sound via the microphone 304. The user preferably presses the record button 318 at the same time as playing the sound to be captured (e.g. a doorbell or smoke alarm). In this illustrated example, the user is required to play the sound and record the sound three times before the sound is sent to a remote analytics system for analysis. A visual indication of each sound capture may be displayed via, for example, progress bars 320*a*, 320*b*, 320*c*. Progress bar 320*a* is shown as hatched here to indicate how the progress bar may be used to show the progress of the sound capture process—here, the first instance of the sound has been captured, so the user must now play the sound two more times.

Once the sounds have been captured successfully, the user interface may prompt the user to send the sounds to the remote analytics system, by for example, displaying a "send" button 322 or similar. Clicking on the send button causes the computing device 314 to transmit the recorded sounds to the remote system. When the remote system has analysed the sound and returned a sound pack (sound model) to the device 314, the user interface may be configured to display a "trained" button 324 or provide a similar visual indication that a sound model has been obtained. Preferably, the sound pack is sent by the device 314 to the security system and used by the security system to identify sounds, as this enables the security system to detect and identify sounds without requiring constant communication with the computing device 314. Alternatively, sounds detected by the security system microphone 304 may be transmitted to the computing device 314 for identification. When a sound has been identified by the security system, it may send a message to the computing device 314 to alert the device to the detection. Additionally, the security system may perform a user-defined action in response to the identification. For example, the camera 302 may be swivelled into the direction of the identified sound.

The device 314 comprises one or more indicators, such as LEDs. Indicator 326 may be used to indicate that the device has been trained, i.e. that a sound pack has been obtained for a particular sound. The indicator may light up or flash to indicate that the sound pack has been obtained. This may be used instead of the trained button 324. Additionally or alternatively, the device 314 may comprise an indicator 328 which lights up or flashes to indicate that a sound has been identified by the security system.

Figure 4A:
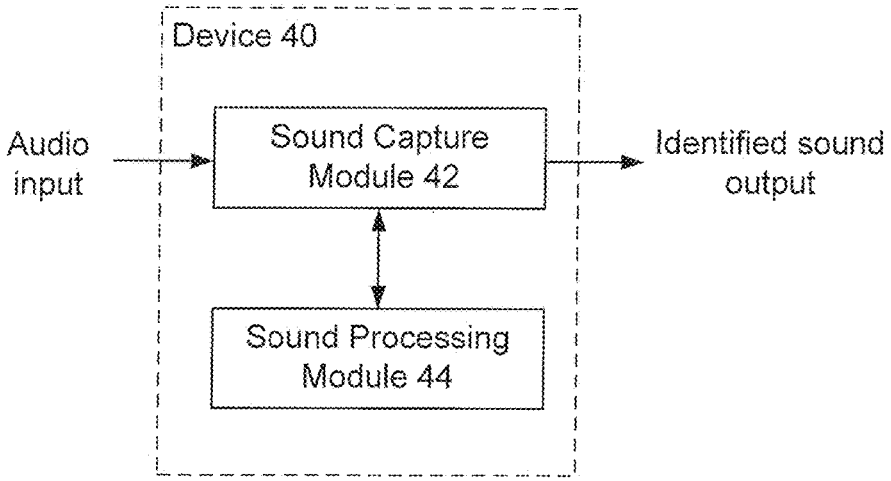
FIG. 4*a* shows a schematic of a system configured to capture and identify sounds.

FIG. 4*a* shows a schematic of a device configured to capture and identify sounds. As described earlier with reference to FIGS. 1*a* to 1*c*, a device 40 may be used to perform both the sound capture and the sound processing functions, or these functions may be distributed over separate modules. Thus, one or both of a sound capture module 42, configured to capture sounds, and a sound processing module 44, configured to generate sound models for captured sounds, may be provided in a single device 40, or as separate modules which are accessible by device 40. The sound capture module 42 may comprise analytics software to identify captured/detected sounds, using the sound models generated by the sound processing module 44. Thus, audio detected by the sound capture module 42 is identified using sound models generated by module 44, which may be within device 40 or remote to it.

Figure 4B:
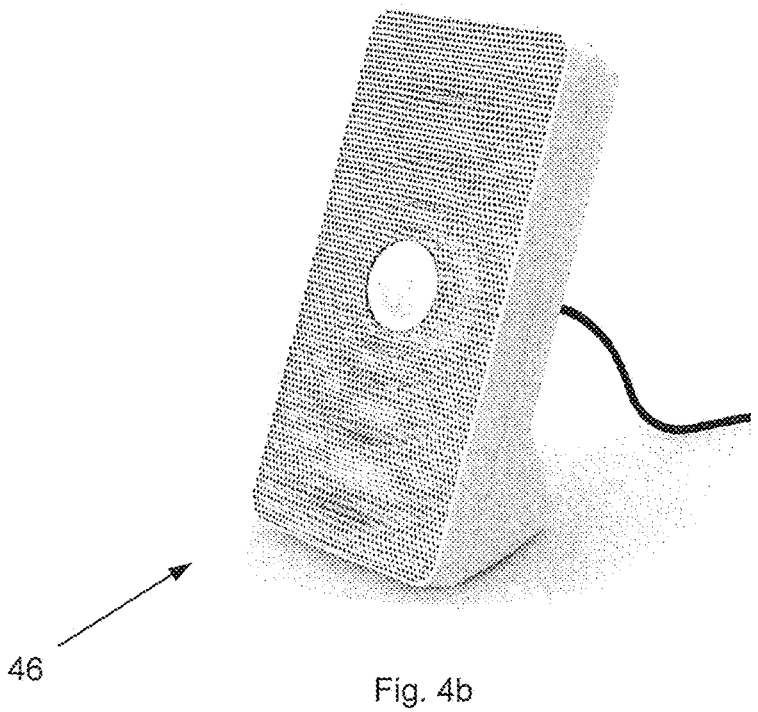
FIG. 4*b* is an illustration of a smart microphone configured to capture and identify sounds.

FIG. 4*b* is an illustration of a smart microphone configured to capture and identify sounds. The smart microphone or smart device 46 preferably comprises a sound capture module (e.g. a microphone), means for communicating with an analytics system that generates a sound model, and analytics software to compare detected sounds to the sound models stored within the device 46. The analytics system may be provided in a remote system, or if the smart device 46 has the requisite processing power, may be provided within the device itself. The smart device comprises a communications link to other devices (e.g. to other user devices) and/or to the remote analytics system. The smart device may be battery operated or run on mains power.

Figure 5:
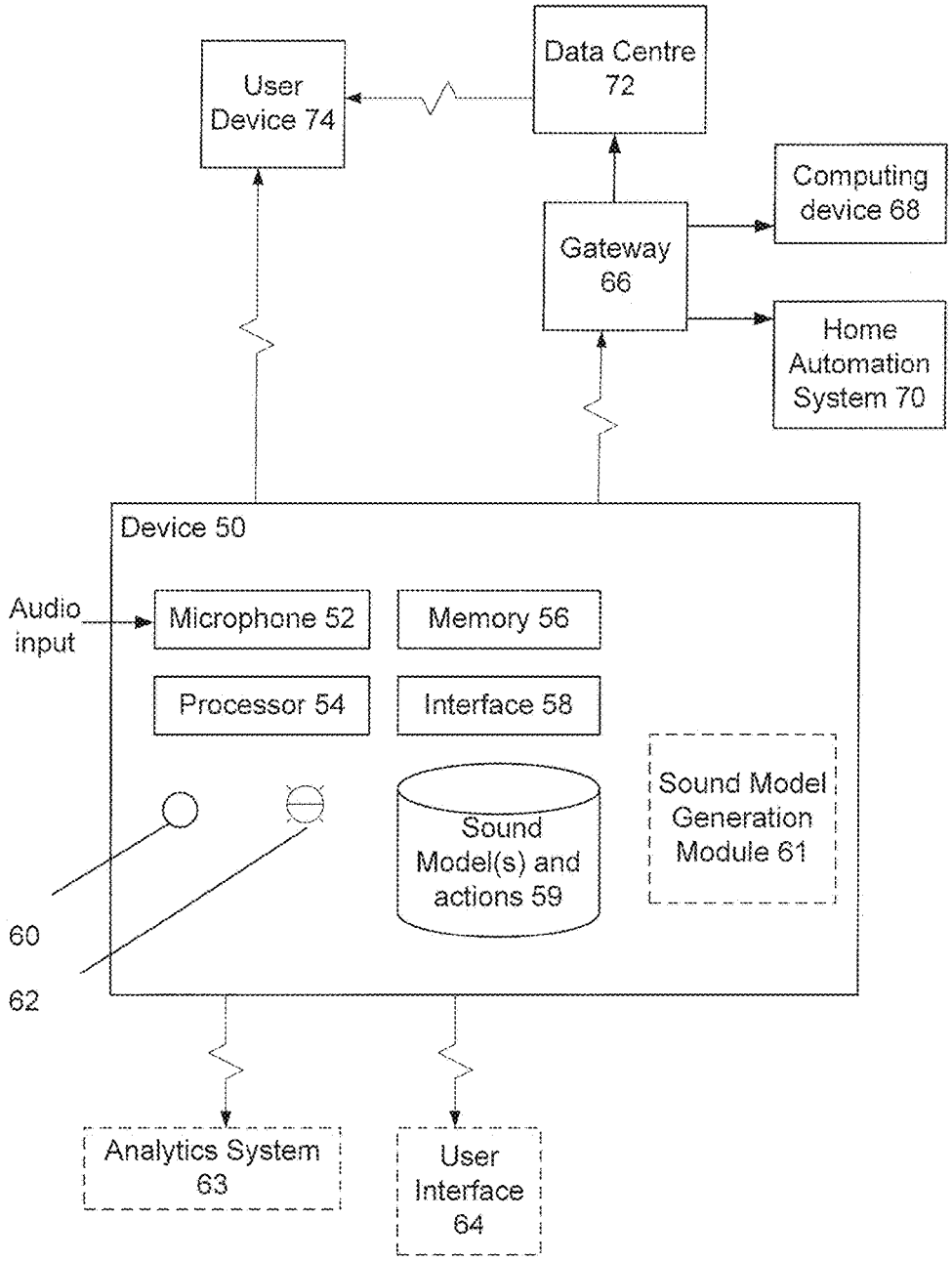
FIG. 5 is a block diagram showing another specific example of a system used to capture and identify sounds.

FIG. 5 is a block diagram showing another specific example of a device used to capture and identify sounds. The system comprises a device 50 which is used to capture sounds and identify sounds. For example, the device 50 may be the smart microphone illustrated in FIG. 4*b*. The device 50 comprises a microphone 52 which can be used to capture sounds and to store the sound models associated with each captured sound. The device further comprises a processor 54 coupled to memory 56 storing computer program code to implement the sound capture and sound identification, and to interfaces 58 such as a network interface. A wireless interface, for example a Bluetooth®, Wi-Fi or near field communication (NFC) interface is provided for interfacing with other devices or systems.

The device 50 comprises a data store 59 storing one or more sound models (or "sound packs"). In example implementations, the sound model for each captured sound is generated in a remote sound analytics system 63, such that a captured sound is sent to the remote analytics system for processing. Alternatively, the sound model may be generated by a sound model generation module 61 within the device 50. In this illustrated example implementation, the device 50 is configured to capture sounds in response to commands received from a user. The device 50 comprises one or more interfaces to enable a user to control to the device to capture sounds and obtain sound packs. For example, the device comprises a button 60 which a user may depress or hold down to record a sound. A further indicator 62, such as an LED, is provided to indicate to the user that the sound has been captured, and/or that further recordings of the sound, and/or that the sound can be transmitted to the analytics system 63 (or sound model generation module 61). The indicator 62 may flash at different rates or change colour to indicate the different stages of the sound capture process. The indicator 62 may indicate that a sound model has been generated and stored within the device 50.

The device 50 may, in example implementations comprise a user interface to enable a user to select an action to associate with a particular sound. Alternatively, the device 50 may be coupled to a separate user interface 64, e.g. on a computing device or user device, to enable this function. When a sound has been identified by device 50, it may send a message to a user device 74 (e.g. a computing device, phone or smartphone) coupled to device 50 to alert the user to the detection, e.g. via Bluetooth® or Wi-Fi. Additionally or alternatively, the device 50 is coupled to a gateway 66 to enable the device 50 to send an SMS or email to a user device, or to contact the emergency services or to control a home automation system, as defined by a user for each sound model.

For example, a user of device 50 may specify for example, that the action to be taken in response to a smoke alarm being detected by device 50 is to send a message (e.g. an SMS message or email) to computing device 68 (e.g. a smartphone, PC, tablet, phone). The device 50 is configured to send this message via the appropriate network gateway 66 (e.g. an SMS gateway or mobile network gateway). The action to be taken in response to the sound of a doorbell ringing may be for example, to turn on a light in the house. (This may be used to, for example, give the impression that someone is in the house, for security purposes). In this case, the device 50 is configured to send this command to a home automation system 70 via the gateway, such that the home automation system 70 can turn on the light, etc.

Another example is if the sound detected is the word "help", "fire" or a smoke alarm. In this case, the device 50 may be configured to send an appropriate message to a data centre 72, which can contact the emergency services. The message sent by device 50 may include details to contact the user of device 50, e.g. to send a message to user device 74.

Wearable Audio Devices

Figure 6:
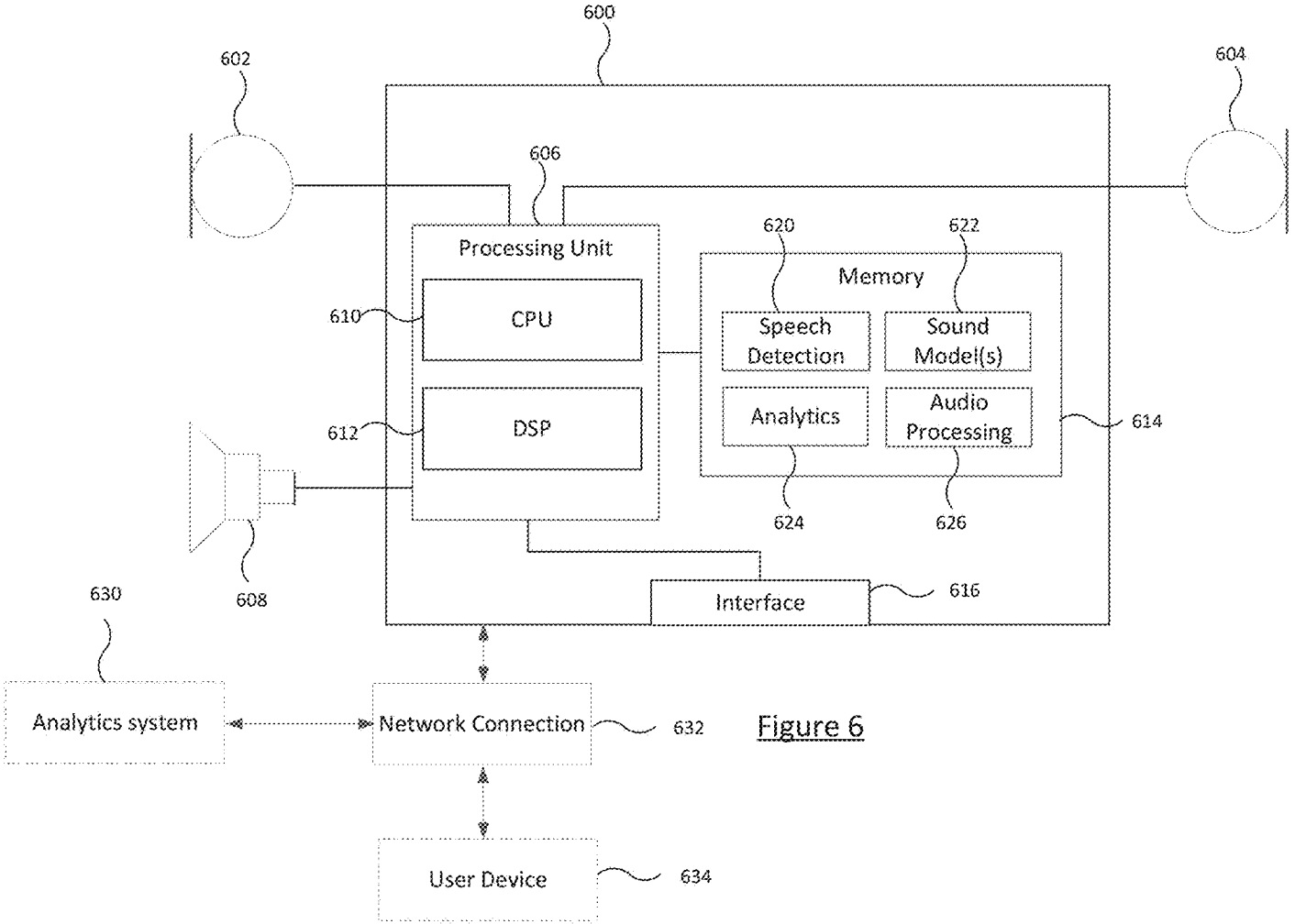
FIG. 6 shows a block diagram of wearable audio device.

FIG. 6 shows a block diagram. The wearable audio device may be a set of headphones, including inner-ear headphones or over-ear headphones, but may also be any other electronic device. The device comprises a processing unit 606 coupled to program memory 614.

The wearable audio device 600 comprises at least one inner microphone 602, configured to capture audio from the wearer, and at least one outer microphone 604, configured to capture audio from the outside environment, both the inner microphone 602 and the outer microphone 604 are connected to the processing unit 606. There is also at least one inner speaker, 608 which is also connected to the processing unit 606, the inner speaker is directed towards the wearer's ear. The processing unit 606 may comprise a CPU 610 and/or a DSP 612. The CPU 610 and DSP 612 may further be combined into one unit.

The wearable audio device 600 may comprise an interface 616, which may be used to interact with, for example, a wearer, a remote system, or any other electronic device. The interface is connection to the processing unit 606.

The memory 614 may comprise a speech detection module 620, a stored sound module 622, an analytics module 624 and an audio processing module 626. The speech detection module 620 contains code that when run on the processing unit 606 (e.g. on CPU 610 and/or a DSP 612), configures the processing unit 606 to detect speech in an audio signal that has been received by the at least one inner microphone 602 and/or the at least one outer microphone 604. Sound model module 622 store sound models that are used in processes, including but not limited to, the identification of a sound or a sound context. The analytics module 624 contains code that when run on the processing unit 606 (e.g. on CPU 610 and/or a DSP 612), configures the processing unit 606 to perform analysis including comparing a sound to a sound model to identify a detected sound model. The audio processing module 626 contains code that when run on the processing unit 606 (e.g. on CPU 610 and/or a DSP 612), configures the processing unit 606 to perform processing on audio signals received by the at least one inner microphone 602 and at least one outer microphone 604. The processing includes but it not limited to altering the volume or altering the equalisation, and altering the active noise cancellation process.

In embodiments, device 600 may comprise only one microphone. In this embodiment, the single microphone may be an inner or an outer microphone.

A wireless interface, for example a Bluetooth®, Wi-Fi or near field communication (NFC) interface is provided for interfacing with a user device 634 and optionally, with a remote analytics system 630. In example implementations, although the device 600 has the capability to analyse sounds, generate sound models itself and identify detected sounds, the device 600 may also be coupled to a remote analytics system 630. For example, the device 600 may provide the captured sounds and/or the locally-generated sound models to the remote analytics system 630 for quality control purposes or to perform further analysis on the captured sounds. Advantageously, the analysis performed by the remote system 630, based on the captured sounds and/or sound models generated by each device coupled to the remote system 630, may be used to update the software and analytics used by the device 600 to generate sound models. Device 600 may be able to communicate with a user device 634, where the user device 634 may act as a microphone and/or perform sound analytics operations. In general, the user device 634 may act as a companion device to device 600. In embodiments, device 600, analytics system 630 and user device 634 may be connected via a network connection 632, the connection may be wireless or wired, or a combination of the two.

Figure 7A:
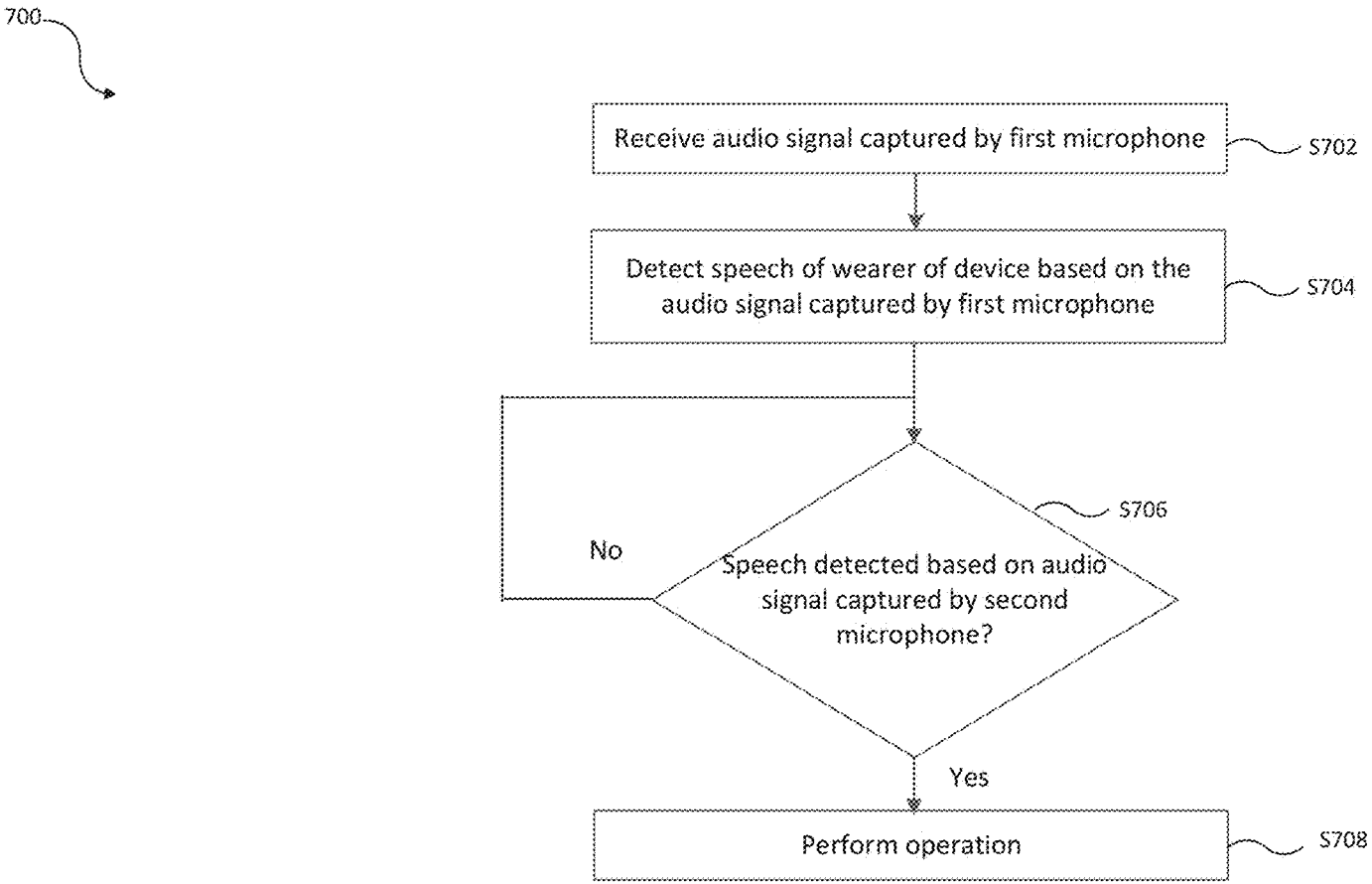
FIG. 7*a* is a flow chart showing example steps of a process implemented by a wearable audio device.

FIG. 7*a* is a flow chart showing example steps of a process 700, performed by the processing unit 606, to detect the speech of a wearer of a hearables device and/or of another speaker(s) and accordingly perform an operation. The processing unit 606 receives an audio signal (S702) via the microphone(s) 602 (otherwise referred to herein as the first microphone). The processing unit 606 runs code from the speech detection module 620 to analyse if the received audio is speech (S704). Processor unit 606 then receives audio from microphone(s) 604 (otherwise referred to herein as the second microphone). The processing unit 606 runs code from the speech detection module 620 to analyse if the received audio (received from the second microphone) is speech (S706). If the audio received by the second microphone is speech then it will cause the wearable audio device 600 to implement a set of operations. The operations may be implemented by the processing unit 606 running code from the audio processing module 626.

Figure 7B:
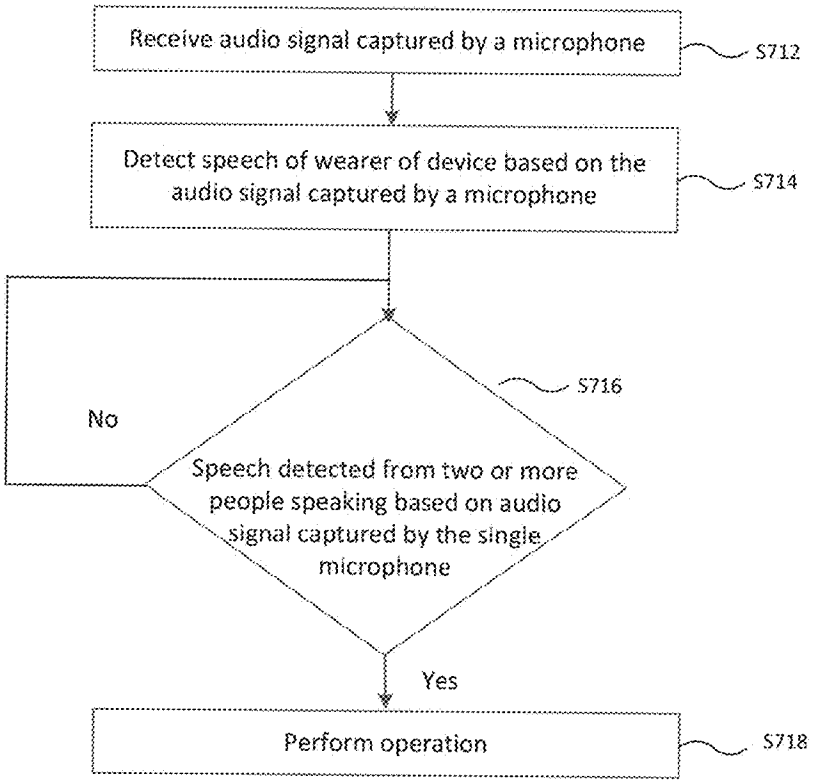
FIG. 7*b* is a flow chart showing example steps of a process implemented by a wearable audio device.

FIG. 7*b* is a flow chart showing example steps of a process 710, performed by the processing unit 606, to detect the speech of a wearer of a hearables device and/or of another speaker(s) and accordingly perform an operation. In embodiments, process 710 can be performed by a device with only a single microphone. The processing unit 606 receives an audio signal (S712) via the microphone 602. The processing unit 606 runs code from the speech detection module 620 to analyse if the received audio is speech (S714). The processing unit 606 runs code from the speech detection module 620 to analyse if the received audio (captured by the single microphone 602) is speech from two or more people (S716). If speech is detected from two or more people then it will cause the wearable audio device 600 to implement a set of operations. The operations may be implemented by the processing unit 606 running code from the audio processing module 626.

Processors are generally able to run at a low computational cost (and thus low power consumption) if limited calculations are being performed, and/or if limited functions are being used by the. We will refer to this situation as the processing unit 606 residing in a low energy-consuming state. Optionally, the processing unit 606 may initially reside in a low energy-consuming state. In this scenario, if the processing unit 606 receives audio from the first microphone (S702 and/or S12) then the processing unit 606 will boot up more modules from the memory 614. Booting up more modules will allow the processing unit 606 to carry out the rest of the process 700 (and/or S710), or other processes. However, by residing in a low energy-consuming state until triggered by receiving audio, the processing unit 606 will consume less energy. Thus, if the power source of the wearable audio device 600 is a battery then the battery of the wearable audio device 600 will last for a longer time period without needing to be recharged.

Figure 8:
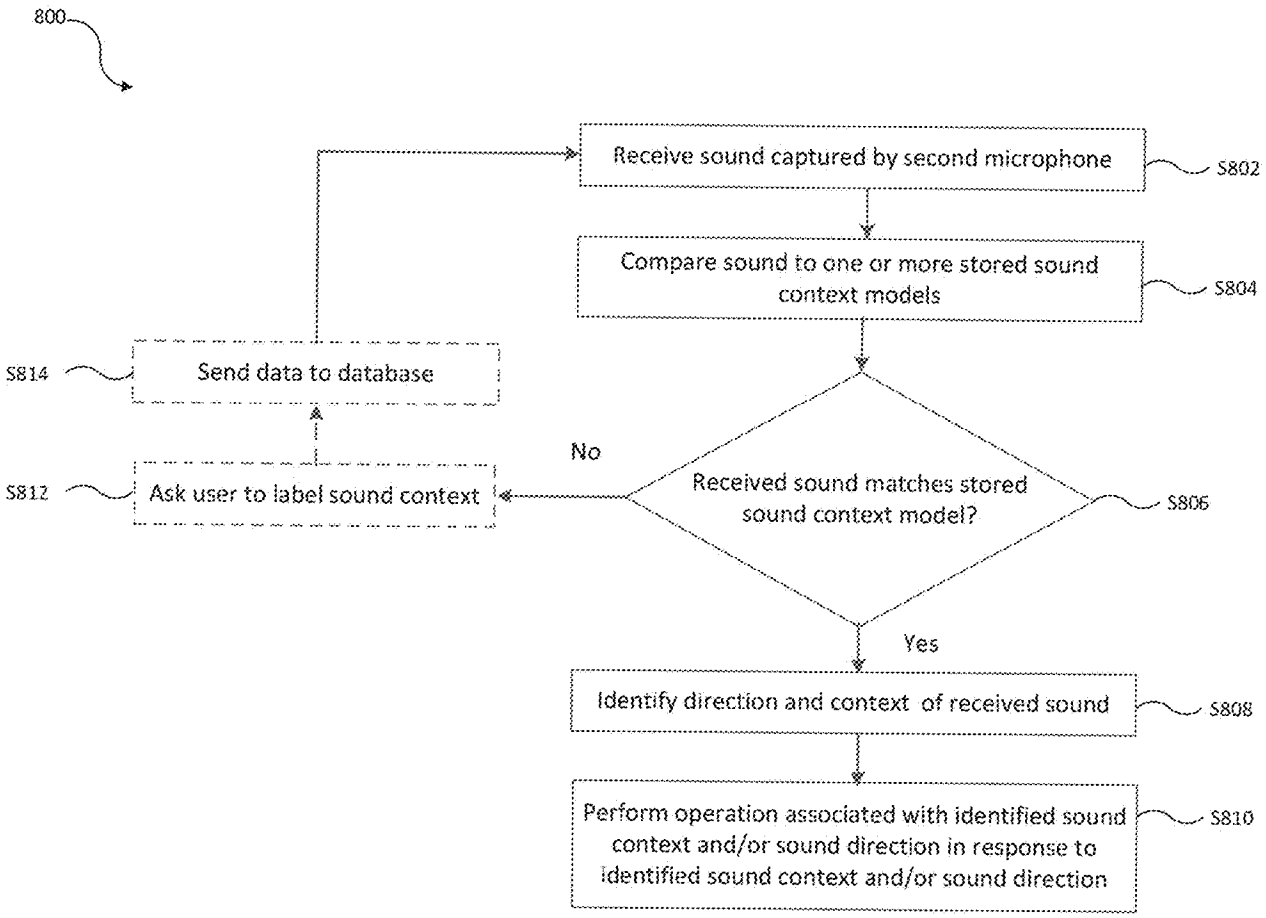
FIG. 8 is a flow chart showing example steps of a process implemented by a wearable audio device.

FIG. 8 is a flow chart showing example steps of a process 800 to identify a context and/or a direction of a detected sound. Processing unit 606 receives sound that has been captured by the second microphone (604 in FIG. 6). The received sound is compared to sound models 622 in memory 614. The sound models may correspond to sound contexts, which correspond to a given environment or situation, for example sounds of "a coffee shop" or "a busy street". At step S806, if the received sound does not match to a stored sound model then the process 800 returns to its S802. At step S806, if the processing unit 606 does determine that the received sound does correspond to a sound model then the received sound can then be identified (S808), and the sound may be labelled with a sound context label. Additionally or alternatively, the direction of the sound may be determined and/or labelled (S808), either as part of the identification step or separate from the identification step. An operation (or a set of operations) can then be performed that is associated with the sound context and/or the sound direction. Operations may include but are not limited to, altering the volume, altering the noise cancellation capabilities, altering the equalisation, or interacting with another device, devices or the wearer.

Optionally, if the received sound does not match with any stored sound models (No, S806), the wearer may be asked to label the received sound with a sound context label (S812) via the interface 616. The sound (or features of the received sound) and the wearer-assigned label could then be sent to a database (S814) via the interface 616. This would be a method of crowdsourcing unknown sound contexts. For example, the data could be sent to the cloud. The interface 616 could also receive data from the cloud.

By way of example, the wearable audio device 600 could be a pedometer (fitness tracker). A common problem is that the regular vibrations felt when the wear is traveling on a train causes the pedometer to count steps. However, the wearable audio device 600 would be able to detect that the wearer is on a train, via the method described above, and therefore stop counting the train's vibrations as footsteps.

Figure 9:
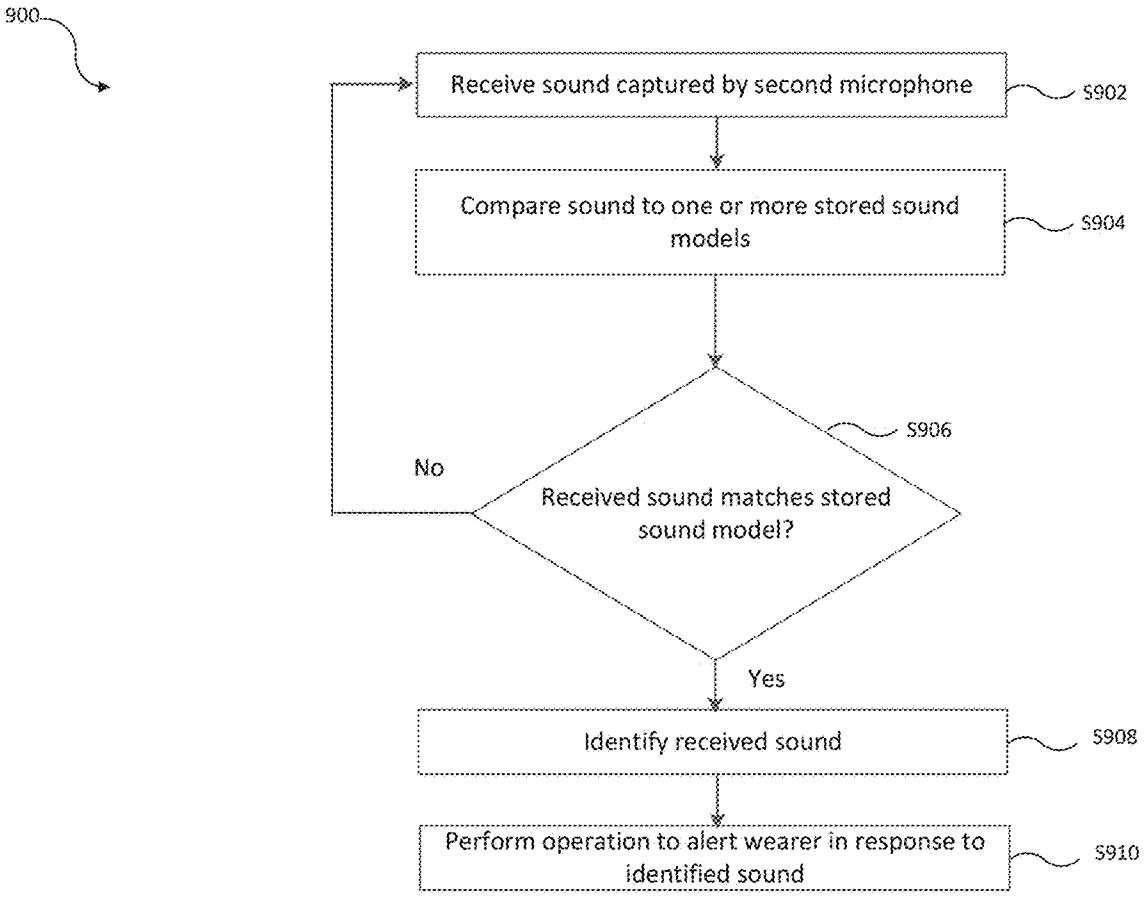
FIG. 9 is a flow chart showing example steps of a process implemented by a wearable audio device.

FIG. 9 is a flow chart showing example steps of a process 900. A processing unit 606 receives sound that has been captured by a second microphone 604 (S902). The processing unit 606 then compares the received sound (by implementing code from the analytics module 624) to one or more sound models (S904). If the received sound does not match with a stored sound model then the process returns step 902 (No, S906). If the received sound does correspond to a sound model (Yes, S906) then the processing unit 606 implements code be identified (S908) the received sound. If the received sound corresponds to a sound model that is associated with a warning or a hazard, then the processing unit 606 implements code stored in the audio processing module 626 to perform an operation to alert or notify the wearer.

By way of example, the processing unit 606 could receive sound from the second microphone 604. The processing unit 606 compares the received sound to a variety of sound models that are stored on the memory 614, and it is found that the received sound matches with the sound model of a car horn. The received sound is then identified as a car horn. The processing unit 606 then performs an operation (or operations). Operations may include but are not limited to, altering the volume, altering the noise cancellation capabilities, altering the equalisation, beam forming, a vibration alert, a sound alert, or other ways of interacting with another device, devices or the wearer. As a continuation of the example, the noise cancellation may be switched off, and the volume of the music playing may be lowered. This would have the effect of allowing the user to hear the car horn, thus being alerted to the danger. Other sounds that may be considered include (but are not limited to), bicycle bells, people shouting, barking dogs, emergency vehicle sirens, smoke/fire alarms.

Whilst embodiments described herein describe the identification of audio and the creation of sound models using certain techniques, it will be appreciated that other techniques of audio identification and creation of sound models may be used.

No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A system comprising at least one microphone, a sound identifier, a wearable audio device, and at least one classifier, wherein:

the wearable audio device comprises at least one transducer; and the sound identifier is configured to:

identify a target sound detected by the at least one microphone; and in response to identification of the target sound, adjust at least one of:

a setting of the wearable audio device;

a parameter of the wearable audio device; and an audio signal provided to the wearable audio device;

the at least one classifier is configured to:

distinguish speech of a wearer of the wearable audio device from the speech of another speaker by processing at least one of:

an amplitude of a detected speech signal; and an energy of a detected speech signal;

allocate a label to the distinguished speech, wherein the label comprises an indication that the detected speech signal is:

speech of a wearer; or speech of another; and use the label to adjust at least one of:

a setting of the wearable audio device;

a parameter of the wearable audio device; and an audio signal provided to the wearable audio device, wherein the at least one classifier comprises a model of a conversation comprising two speakers, and wherein the at least one classifier is further configured to distinguish speech of the wearer of the wearable audio device from the speech of another speaker by processing the detected speech signal using the model.

2. The system of claim 1, wherein the wearable device comprises noise cancelling headphones.

3. The system of claim 1, wherein the sound identifier is further configured to:

distinguish between two or more sounds; and take one of two or more actions dependent on the distinguished sounds.

4. The system of claim 1, wherein the at least one classifier is configured to:

detect an intonation of the detected speech;

allocate a label to the detected speech, wherein the label comprises an indication of the detected intonation of the detected speech; and use the label to adjust at least one of:

a setting of the wearable audio device;

a parameter of the wearable audio device; and an audio signal provided to the wearable audio device.

5. The system of claim 1 wherein the sound identifier identifies presence of a conversation, the conversation comprising speech of a first speaker is followed by speech of a second, different speaker, and vice-versa.

6. The system of claim 1, wherein the system further comprises a personal assistant system:

wherein the personal assistant system is configured to communicate a message to the user in response to a detected sound or a detected sound environment; and wherein identification of a detected sound or a detected sound environment determines at least one of semantic content, intonation, pitch and another property of the message.

7. The system of claim 6, wherein at least one of:

the message comprises a description of a location of the detected sound; and the message is presented to the wearer's ears to give the impression of coming from the direction of the detected sound; and the message is synthesized speech.

8. The system of claim 7, wherein the location of the detected sound is determined by at least one of:

selecting at least one of a plurality of directional microphones pointing in different directions; and controlling beam forming using an array of microphones.

9. The system of claim 7, wherein the message is presented to the wearer's ears to give the impression of coming from the direction of the detected sound by at least one of:

controlling the filtering of signals delivered to ears of the wearer;

controlling the timing of signals delivered to the ears of the wearer; and applying one or more head-related transfer functions to the message.

10. The system of claim 1 wherein, in response to the identification of the target sound, the system is configured to:

determine the location of the target sound by at least one of:

selecting at least one of a plurality of directional microphones pointing in different directions; and controlling beam forming using an array of microphones; and apply one or more head-related transfer functions to the target sound to give the impression to the wearer that the target sound is coming from the direction of the detected sound.

11. The system of claim 1, wherein the wearable audio device is configured to:

reside in a low powered state;

upon detecting a wake sound, boot up a processor of the wearable audio device into a higher powered state, wherein the processor when in the higher powered state is configured to:

identify a target sound detected by the at least one transducer; and in response to identification of the target sound, adjust at least one of:

a setting of the wearable audio device;

a parameter of the wearable audio device; and an audio signal provided to the wearable audio device; and return to a low powered state after a duration of time in which it is has been determined that no sound has originated from the wearer.

12. A noise cancelling headphone system comprising at least one microphone, a sound identifier, and at least one transducer:

wherein the sound identifier is configured to identify a target sound detected by the at least one microphone; and in response to identification of the target sound, adjust a degree of noise cancellation applied by the noise cancelling headphone system to allow more external sound to reach a wearer's ear;

wherein the sound identifier is further configured to:

identify presence of speech;

differentiate between speech from the wearer and speech from an interlocutor;

in response to the identification of presence of speech originating from the interlocutor, adjust the degree of noise cancellation applied to allow more external sound to reach the wearer's ear; and in response to the identification of presence of speech originating from the wearer, adjust the degree of noise cancellation applied to allow less external sound to reach the wearer's ear.

13. The system of claim 12 wherein adjustment of the degree of noise cancellation applied comprises allowing only a selected portion of the external sound to reach the wearer's ear, wherein the selected portion of external sound corresponds to the target sound.

14. The system of claim 12, wherein the sound identifier is configured to distinguish between presence of speech originating from a background source and presence of speech originating from a foreground sound;

in response to the identification of presence of speech originating from a background source, adjust the degree of noise cancellation applied to allow less external sound to reach the wearer's ear; and in response to the identification of presence of speech originating a foreground source, adjust the degree of noise cancellation applied to allow more external sound to reach the wearer's ear.

15. A method of responding to external sound, the method comprising steps of:

capturing a target sound at a noise cancelling headphone;

identifying the target sound by comparing the target sound to a sound model;

adjusting a degree of noise cancellation applied by the noise cancelling headphone system to allow more external sound to reach a wearer's ear;

identifying presence of speech;

differentiating between speech from the wearer and speech from an interlocutor;

in response to the identification of presence of speech originating from the interlocutor, adjusting the degree of noise cancellation applied to allow more external sound to reach the wearer's ear; and in response to the identification of presence of speech originating from the wearer, adjusting the degree of noise cancellation applied to allow less external sound to reach the wearer's ear.

* * * * *